US006331839B1

(12) United States Patent
Grenell

(10) Patent No.: US 6,331,839 B1
(45) Date of Patent: Dec. 18, 2001

(54) SATELLITE ANTENNA ENHANCER AND METHOD AND SYSTEM FOR USING AN EXISTING SATELLITE DISH FOR AIMING REPLACEMENT DISH

(76) Inventor: Burt Baskette Grenell, 901 S. 19th St., Arlington, VA (US) 22202

( * ) Notice: Subject to any disclaimer, the term of this patent is extended or adjusted under 35 U.S.C. 154(b) by 0 days.

(21) Appl. No.: 09/517,122

(22) Filed: Mar. 1, 2000

Related U.S. Application Data

(63) Continuation-in-part of application No. 09/482,650, filed on Jan. 13, 2000, now Pat. No. 6,215,453.
(60) Provisional application No. 60/124,856, filed on Mar. 17, 1999, and provisional application No. 60/132,422, filed on May 4, 1999.

(51) Int. Cl.[7] ..... H01Q 3/20
(52) U.S. Cl. ..... 343/840; 343/839; 343/882
(58) Field of Search ..... 343/840, 916, 343/781, 882, 839; H01Q 19/00, 19/12, 3/16, 3/18, 3/20

(56) References Cited

U.S. PATENT DOCUMENTS

| | | | |
|---|---|---|---|
| D. 400,888 | 11/1998 | Schutzius | D14/299 |
| 1,689,629 | 10/1928 | Haworth | 343/890 |
| 3,209,361 | 9/1965 | Webb | 343/781 |
| 3,406,393 | 10/1968 | Kulik | 343/777 |
| 3,599,218 | 8/1971 | Williamson et al. | 343/840 |

(List continued on next page.)

FOREIGN PATENT DOCUMENTS

| | | | |
|---|---|---|---|
| 3911445 A1 | 10/1990 | (DE) | 343/912 |
| 2167904 A | 6/1986 | (GB) | 343/840 |

OTHER PUBLICATIONS

Advertisement from Feb. 1999 issue of *Satellite Direct* for "SGard Rain Fade Device" (p. 21).
SGard Incorported Home Page, Feb. 17, 1999, http://www.sgard.com/ (Internet Article).
Lee, C.K., et al., *Compound Reflector Antennas*, 139 IEE Procedings–H 135–138 (1992).

*Primary Examiner*—Michael C. Wimer
(74) *Attorney, Agent, or Firm*—Piper Marbury Rudnick & Wolfe LLP; Wilburn L. Chesser

(57) ABSTRACT

An easily installable signal enhancement addition for a satellite dish, and method for using an installed dish as a reference that allows installation of the enhancement without re-acquiring the satellite signal or re-aiming the dish. In one variation, the enhancement includes a reflector addition fitted with fasteners that locate the reflector against the existing dish, and use of the original feed horn, which is relocated using a support extension. This variation avoids the "shadow" of the feed horn and its support arm, and minimizes the reflective surface area at the lower end of the dish, which reduces collection of such interfering material as snow, rain, and debris. In variations using increased reflector size, the enhancement reduces loss of signal during inclement weather or in other situations in which the satellite signal is partially blocked. In one variation, the added reflector is a standard parabolic reflector superimposed over the original reflector, or replacing it on its mount. In a second variation, the added reflector is custom designed to extend the existing dish surface only at the original reflector's upper edge. In a third variation, the added reflector is ring-shaped and attached at the outer edge of the original reflector. Also disclosed is a method and system for installing an enhanced dish using an installed dish as a reference, the enhanced dish receiving signals from multiple satellites simultaneously, and adjustment of offset occurring using the aiming point of the original dish and a lookup table for the geographical location of installation.

23 Claims, 18 Drawing Sheets

U.S. PATENT DOCUMENTS

| | | | |
|---|---|---|---|
| 3,631,504 | 12/1971 | Suetaki et al. | 343/840 |
| 3,733,609 | 5/1973 | Bartlett | 343/782 |
| 3,983,560 | 9/1976 | MacDougall | 343/781 |
| 4,298,877 | 11/1981 | Sletten | 343/781 |
| 4,506,270 | 3/1985 | Katagi et al. | 343/914 |
| 4,516,130 | 5/1985 | Dragone | 343/781 |
| 4,585,317 | 4/1986 | Hodges et al. | 350/628 |
| 4,689,637 | 8/1987 | Ochiai et al. | 343/914 |
| 4,860,022 | 8/1989 | Dobroski | 343/840 |
| 5,298,911 | 3/1994 | Li | 343/912 |
| 5,334,990 | 8/1994 | Robinson | 343/840 |
| 5,438,340 | 8/1995 | Fukuzawa et al. | 343/781 |
| 5,456,779 | 10/1995 | Sinha | 156/91 |
| 5,644,322 | 7/1997 | Hayes et al. | 343/915 |
| 5,675,348 | 10/1997 | Okada et al. | 343/781 |
| 5,796,370 | 8/1998 | Courtonne et al. | 343/781 |
| 5,907,310 | 5/1999 | Seewig et al. | 343/786 |

SATELLITE ANTENNA ENHANCER AND METHOD AND SYSTEM FOR USING AN EXISTING SATELLITE DISH FOR AIMING REPLACEMENT DISH

This application is a continuation-in-part of applicant's U.S. patent application Ser. No. 09/482,650 of Burt Grenell, titled "SATELLITE ANTENNA ENHANCER AND METHOD AND SYSTEM FOR USING AN EXISTING SATELLITE DISH FOR AIMING REPLACEMENT DISH" filed Jan. 13, 2000, now U.S. Pat. No. 6,215,453. This application also claims priority to applicant's copending U.S. Provisional Patent Application Serial No. 60/124,856 of Burt Grenell, titled "SATELLITE ANTENNA ENHANCER" filed Mar. 17, 1999, and to applicant's copending U.S. Provisional Patent Application Serial No. 60/132,422 of Burt Grenell, titled "SATELLITE ANTENNA ENHANCER USING FULL DISH" filed May 4, 1999.

FIELD OF THE INVENTION

The present invention relates to a device for satellite antenna reception enhancement and more particularly to a satellite dish extension for providing signal enhancement. The invention also relates to a method and system for easily mounting a larger or any replacement reflector in an optimal position, avoiding the need to re-aim the dish assembly, and, if necessary to a given application, permitting adjustment to the placement and retention of the relatively costly feed horn.

BACKGROUND

Satellite dishes have become very prominent in today's society. Many people use them to receive television signals directly. This eliminates the need, for example, for cable connections between homes and television service providers. One problem with these satellite dishes is their size. Big satellite dishes can be an eyesore on a homeowner's property.

When constrained to use a small dish reflector, typically 18 inches in diameter, another problem develops. This problem is that the amount of power that is focused to the feed horn is small relative to a much larger dish. In general, the smaller the dish, the fewer electromagnetic waves collected by that dish and focused to the feed horn. The fewer electromagnetic waves that are focused to the feed horn, the lower the signal's power that is transmitted to the feed horn.

This problem of low power becomes exacerbated during cloudy, stormy, or otherwise inclement weather—a problem referred to as "rain fade." As the electromagnetic waves are propagating from the satellite to the individual satellite dishes, clouds or other water or the like, or other atmospheric disturbances can absorb or reflect some of the radiation. Thus, for example, on a rainy day, using a small dish, the signals reflected to the feed horn may become too weak to provide proper reception. In the television example, this can result in the picture freezing, breaking into parts, or being entirely lost until the interference decreases.

The primary source of interference from rain fade is from raindrops or other forms of moisture or particles in the atmosphere between the satellite and the dish. Water, for example, absorbs microwave energy, so increased amounts of water in the atmosphere between the dish and the satellite increase the likelihood of interference with reception. Thus, heavy cloud cover absorbs a small amount of the energy, really heavy cloud cover absorbs a large amount of energy, and rain dropping through the atmosphere typically absorbs an even greater amount of energy.

The variation in signal strength resulting from rain fade may be seen during rain events by observing a signal strength meter. Many systems for satellite reception include an on-screen signal strength meter that may be viewed, for example, on a television screen. During a rainstorm, it has been experimentally determined that signal loss generally occurs with a typical existing 18-inch Digital Satellite Systems (DSS) satellite dish system at approximately 20% to 30% aperture efficiency, which is typically called "signal strength" level in on-screen guides.

Once the signal falls below about 30%, the digital system used with satellites typically loses the signal completely, and, for a television, no picture at all is received. This loss of picture occurs, depending on the part of the United States or other part of the world in which the receiver is located, for example, between one-tenth of one percent to four-tenths of a percent of the time. It has also been estimated that an average of 24 hours of lost signal per year occurs for a typical satellite system installed in the United States. This problem is particularly annoying to viewers when the signal is lost when they have paid for a pay-per-view movie or are entertaining guests or customers (e.g., bar customers watching sporting events). People who buy these types of satellite receivers typically have made a significant investment in the system and programming, and expect reliable performance. As a result, there is a need for a simple, relatively inexpensive solution to the problem of rain fade.

One known approach to addressing rain fade is to attempt to block rain from collecting on the antenna dish reflector itself. For example, SGard Incorporated of Pocahontas, Arkansas, provides an extension or hood mounted perpendicular to the face of and above the rain reflector so as to prevent such rain collection. This device appears to have received Design Pat. No. 400,888. A problem with this approach is that it only addresses reduced signal resulting from collection of rain on the reflector surface itself. Generally, the maximum signal attenuation resulting from distortion of the dish surface caused by rain collection and splashes is much less than the attenuation caused by water in the atmosphere that interferes with reception.

It is also known in the art to provide three part antennae, which include two extensions for circular transmission antennae, such as those used for vehicle-mounted communications antennae. U.K. Patent Application No. 2167904A of Butcher describes such an antenna. The invention of Butcher provides for extension of the parabolic surface of the dish used by such transmitters and receivers, but does not address a number of problems for small television or the like signal receivers. For example, the invention of Butcher does not address the problem of additional wind resistance and other stresses of the extensions to the dish. The invention of Butcher also does not address shape requirements for small dishes, which typically have offset feed horn collectors placed near the lower part of the antenna and reflectors that cover only the upper portion of possible parabolic reflector area, while also addressing the problem of collection of rain, debris, or other matter on the antenna reflector surface. The invention of Butcher is also not easily installable. The Butcher invention further fails to address the likelihood of a mismatch between the new dish shape and the illumination pattern of the transmission feed horn. Thus, the added "wings" on the dish do not reflect significant energy that can be collected by the feed horn in satellite dish applications and the modification has very limited utility.

An article in April 1992 IEE Proceedings-H titled "Compound Reflector Antennas," by Lee et al. describes a compound reflector antenna for reflecting equal beamwidths at two separate frequency bands using inner and outer reflective surfaces of differing materials. The article of Lee does not describe reflector extensions for use with small satellite dishes to increase gain, nor does it address particular aspects of adapting reflector extensions to existing dishes, particularly smaller satellite dishes. The article also does not address the need to alter the location of the feed horn to place it at the focal point of the extended reflector.

U.S. Pat. No. 3,631,504, issued to Suetaki et al. shows an antenna having a parabolic reflector that includes a wave absorber at its edge. The '504 patent does not describe reflector extensions for use with small satellite dishes to increase gain, nor does it address particular aspects of adapting reflector extensions to existing dishes, particularly smaller satellite dishes. The patent also does not address the need to alter the location of the feed horn for use with an extended reflector.

U.S. Pat. No. 5,298,911, issued to Li shows an antenna having a skirt at its rim, the skirt having a serrated surface and rolled curvature to control amplitude and phase taper of the transmitting or receiving radiation. The '911 patent does not describe reflector extensions for use with small satellite dishes to increase gain, nor does it address particular aspects of adapting reflector extensions to existing dishes, particularly smaller satellite dishes. The patent also does not address the need to alter the location of the feed horn for use with an extended reflector.

U.S. Pat. No. 5,456,779, issued to Sinha relates to a method for attaching an electrically conductive mesh material to an antenna structure for use as a high performance radio frequency reflective surface. The '779 patent does not describe reflector extensions for use with small satellite dishes to increase gain, nor does it address particular aspects of adapting reflector extensions to existing dishes, particularly smaller satellite dishes. The patent also does not address the need to alter the location of the feed horn for use with an extended reflector.

Larger replacement satellite dish antennae are available in the aftermarket for consumers, but these have achieved very small market penetration, as they require time consuming and difficult installation and dish pointing which is daunting to most dish owners. Some owners of existing installed dishes have a need to replace these dishes with new dishes offering additional features.

There is thus a need for an easily installable and cost-effective device for increasing the reflective power of a dish for a received signal transmission to overcome rain fade and other signal interference without significantly increasing vulnerability to wind damage or other sources of stress and without producing the problem of creating additional reflective surface that may collect rain, snow, debris, or other matter, thus interfering with the received signal. There is also a need for a simple method for using an installed dish to pre-aim a new dish. There is yet another need for an easy method of installing a dish with additional features (such as the ability to pick up signals from two satellite locations at once) by using an existing installed dish as an aiming reference.

SUMMARY OF THE INVENTION

It is an advantage of the present invention to overcome the limitations of the prior art by providing a single-piece antenna reflector surface that is easily mountable to an existing small-sized television or other satellite transmission receiver.

It is another advantage of the present invention to provide a superimposedly attachable 24-inch parabolic reflector dish, which is designed to mate firmly on the front outer circumference of the existing dish, providing strength in the face of wind resistance.

It is another advantage of the present invention to provide an extension that increases the parabolic reflective area of the receiver without significantly increasing the likelihood of snow, debris, or other material collection on the surface of the antenna. It is yet a further advantage of the present invention to provide greater extension of the dish area "above" and laterally outward toward the "sides" of the existing reflector.

It is another advantage of the present invention to provide a feed horn support arm extension for repositioning the feed horn to the focal point produced with the added reflector.

An embodiment of the invention thus provides a larger parabolic reflective surface for reflecting a signal to a feed horn for a satellite dish, the satellite dish having a reflective surface area retaining the same focal length to diameter ratio, and a feed horn and bracket arm for the feed horn. The larger dish is easily attachable to the satellite dish and has an outer circumference that conforms to the pattern of "illumination" or collection for which the existing dish's feed horn was designed. For embodiments in which the new dish surface is centered on the original dish surface, the new dish surface optionally includes an opening at the lower end for receiving the feed horn support arm.

An embodiment of the invention provides for increasing signal gain in an existing satellite dish without re-aiming the dish assembly, utilizing a larger reflector designed to easily connect to the existing dish, and fitted with attachments to do so, in optimal position to reflect energy to the existing feed horn when the feed horn is repositioned with an easily installable extension for the existing feed horn support arm. The extension is hollow in one embodiment, allowing the cable(s) to pass through to the feed horn. This extension is formed in the shape of an I-Beam in another embodiment, allowing the cables to be routed to the sides of the extension, avoiding the need to detach and reconnect the cables during installation of the extension.

The added dish may likewise be made smaller, and the existing feed horn support arm replaced with, for example, a short extension to similarly reposition the feed horn for use with the correspondingly shorter focal distance of a smaller added dish.

The added dish may likewise be shaped differently than the original dish, offering additional features with, for example, an arm extension which attaches two feed horns at dual focal points of the new dish.

The added dish of one embodiment of the present invention is designed to reproduce any portion of the full "parent" parabolic reflector reflective surface, maintaining the same focal length to diameter ratio of the original reflector, allowing a design which positions this surface such that area is added primarily above and to the sides of the existing reflector, so as to reduce the accumulation of such material as debris and rain water, and to avoid adding area in the shadow of the feed horn assembly. In an embodiment of the present invention, the added parabolic surface is easily removable, so that the user may add or remove the enhancement dish as desired. In another embodiment, the extension mounts easily and permanently using, for example, pre-attached adhesive with peel-off backing, snaps, clamps, or one or more other fasteners.

In particular, the present invention includes three distinct embodiments of dish additions. The first embodiment of the present invention utilizes a standard 24-inch parabolic reflector mass producible at low cost. This reflector has the same focal length to diameter ratio of the original smaller dish. In one variation of this embodiment, this superimposed reflector extends the surface approximately equally in all directions, and includes an opening near the edge of the new reflector to permit passage of the original feed horn support arm. In another variation of this embodiment, the addition mounts above the feed horn and is attached to the support arm. In addition to installing this standard larger reflector, these embodiments also include an addition to or replacement for the support arm to reposition the feed horn so as to accommodate the focal point of the altered reflective surface, as necessary.

In the second embodiment of the present invention, the parabolic curve of a new dish is custom designed to reproduce more of the surface area of the "parent" parabolic surface (i.e., full size of a parabolic area with the same focal length to diameter ratio) only in the area "above" and to the "sides" of the offset dish, rather than superimposedly centering a reflective addition over the original dish. The extension also circumscribes the lower portion of the potential reflector area so that the extension avoids collection of rain, debris, or other material at the lower end of the extension. In one embodiment, the shape of the outer circumference of the added dish is slightly more elongated than the original dish, but retains the original shape when viewed from the perspective of either the feed horn or the incoming signal path. An extension for the feed horn arm is also required with this embodiment to place the existing feed horn at the focal point of the new dish.

The third embodiment of the present invention comprises an easily installable parabolically curved ring to provide greater reflective area than the existing satellite dish by adding reflective surface area, and retaining the same shape of outer circumference as the existing dish. The focal point remains the same, but a lens, which, for example, is fabricated from foamed Teflon or other suitable material, is positioned in front of the feed horn to increase the area "illuminated" by the feed horn. This allows the existing dish's feed horn/low noise block (LNB) to be utilized to collect the signal from the larger dish surface. The larger dish is thus "flatter" across any given area than the original dish, permitting easy mounting, and moving of the focal point further from the dish.

The present invention also comprises a method for mounting a new dish with added features in the face of an existing, aimed dish, or to the existing dish mounting bracket, using the existing dish or bracket as reference point, permitting installation of the new dish, without re-acquiring the satellite signal or re-aiming the dish. In some instances of this embodiment, additional adjustment parameters are accommodated, such as the "twist" on positioning of the dish about an axis extending through the center of the dish from front to back. This adjustment is addressed, for example, through marks on the lower edge of the replacement dish, which are alignable with a mark on the pedestal adapter according to a table based upon the zip code or latitude and longitude of the location of the dish installation. An embodiment of the invention therefore provides a system for automated "aiming" of any replacement dish through the use of an installed dish of known dimensions and shape, which serves as a reference. This allows the design of a replacement dish with additional features, which include, but are not limited to, increased size and/or the ability to receive signals simultaneously from more than one satellite location.

For embodiments one and two, an arm extension addition is provided to reposition the feed horn(s) to within the signal gathering range of the new reflector. Further, the added surface area of the three dish addition embodiments reproduces the pattern of dispersion of the existing feed horn, incorporating the focal length to diameter ratio of the original reflector that was designed for use with the feed horn in embodiments one and two, and altering the dispersion pattern of the feed horn with a lens in embodiment three. Existing dishes use feed horns with varying patterns of "edge taper," typically reducing signal gathering by approximately 10 dB at the edge of the dish surface. To extend the signal gathering area of the feed horn sufficiently to permit addition of usable reflective surface in accordance with the present invention, the feed horn is moved further from the dish surface, along the axis of the "boresight" of the feed horn (direction of the focal axis), and a slight increase in elevation or other offset is provided to the feed horn, as necessary for use with reflector surfaces adding more parabolic surface "above" and to the "sides" of the original dish. In embodiments one and two of the present invention, the distance between the feed horn and the new reflector surface is increased directly proportionally to the new reflector size, as the new reflector has the same focal length to diameter ratio as the original dish.

Yet a further embodiment involves use of replacement of the existing dish with a larger or otherwise varied dish providing enhancement features, using the existing already "aimed" dish mounting support hardware and one or more adjustable adapters, referred to as mounting "pedestals," allowing replacement of the original dish with the enhancement dish without requiring reorientation or re-aiming of the enhancement dish, and, if necessary or desired, accommodating other features, such as skewing, twisting, or other rotation of the added dish, which are permitted when the added dish includes a feed horn support integrated into the dish edge. The present invention also allows adjustment of each of these parameters, which is particularly useful with receiving signals from multiple satellites simultaneously. In an embodiment of the present invention, the pedestal is used to install a larger dish in conjunction with a feed horn extension, as disclosed, and multiple pedestals are packageable with a one or more enhancement dishes to allow the addition of the enhancement dish to a wide range of existing dish mountings.

One embodiment of the pedestal and enhancement dish assembly for receiving multiple satellite signals simultaneously includes use of two wedge-shaped cylindrical portions having adjustment slots. The enhancement dish is attached to the pedestal via the two wedge-shaped cylindrical portions and mounting bolts or other attachment features extending through the slots. The wedge-shaped cylindrical portions and the adjustment slots allow adjustment of the rotation and skew of the enhancement dish relative to the multiple satellites, to permit an optimal signal to be simultaneously obtained. The optimal offset angle to obtain maximum signal can be determined, for example, using a lookup table that provides predetermined angles and skews by zip code for the location of the dish.

In another embodiment, the pedestal is used to install an enhancement dish that includes a feed horn arm integrated into the edge of the enhancement dish, for which no alteration of the arm is necessary. Again, more than one pedestal may be required to accommodate variations in the design of the mounting supports across the range of extant dishes.

To achieve the stated and other features and advantages of the present invention, an embodiment of the invention provides a method of increasing signal gain for a satellite dish assembly, the assembly including an original reflector and a feed horn attached to a feed horn support arm, wherein the original reflector has an associated focal length, diameter, and focal length to diameter ratio, and wherein the feed horn has a collection pattern, the method comprising: attaching an enhancement reflector to the original reflector; and attaching a feed horn extension to the feed horn support arm, such that the feed horn is optimally repositioned to receive reflected energy; wherein the enhancement reflector has a shape retaining the focal length to diameter ratio of the original reflector and conforms to the collection pattern of the feed horn.

To achieve the stated and other features and advantages of the present invention, an embodiment of the invention further provides a system for providing increased signal gain for a satellite dish assembly, the assembly including an original reflector and a feed horn attached to a feed horn support arm, wherein the original reflector has an associated focal length, diameter, and focal length to diameter ratio, and wherein the feed horn has a collection pattern, the system comprising: an enhancement reflector attachable to the original reflector; and a feed horn extension, the feed horn extension being attachable to the feed horn support arm, such that the feed horn is optimally positioned to receive reflected energy; wherein the enhancement reflector has a shape retaining the focal length to diameter ratio of the original reflector and conforms to the collection pattern of the feed horn.

To achieve the stated and other features and advantages of the present invention, an embodiment of the invention further provides a reflective enhancement for reflecting a signal to a feed horn for a satellite dish, the satellite dish having a reflective surface area, a circumferential edge, and a feed horn support arm for the feed horn, the feed horn support arm positioning the feed horn at a focal point for the reflective surface area, and the feed horn having a collection pattern, the reflective enhancement comprising: a one-piece reflective addition attachable to the satellite dish, such that the reflective addition extends the reflective surface area of the dish, the attached reflective addition producing an enhanced reflective surface area; wherein the reflective addition has a shape conforming to the collection pattern of the feed horn, the enhanced reflective surface area increasing the reflected signal to the feed horn and having a repositioned focal point; and an extension for the bracket arm for repositioning the feed horn to the repositioned focal point.

To achieve the stated and other features and advantages of the present invention, an embodiment of the invention further provides a satellite dish enhancer for a satellite dish having a reflective surface, a feed horn extension, and a feed horn, wherein the feed horn is fixably held at a first distance relative to the reflective surface by the feed horn extension, the enhancer comprising: an added reflective surface attachable to the reflective surface; and a support arm enhancement attachable to the satellite dish, such that the feed horn is fixably held a second distance relative to the reflective surface.

To achieve the stated and other features and advantages of the present invention, an embodiment of the invention further provides a television satellite dish enhancer for a television satellite dish having an existing parabolic reflector, a feed horn, and a feed horn support arm, wherein the existing parabolic reflector has an existing reflector focal point, and wherein the feed horn support positions the feed horn at the existing reflector focal point, the enhancer comprising: a parabolic dish reflector addition, the reflector addition being superimposedly attachable to the existing reflector, wherein the reflector addition has a reflector dish addition focal point; and a feed horn extension attachable to the feed horn support arm, such that the feed horn is repositioned at the focal point of the new reflector.

To achieve the stated and other features and advantages of the present invention, an embodiment of the invention further provides a system for increasing signal gain for a satellite dish assembly, the assembly including an original reflector and a feed horn attached to a feed horn support arm, the feed horn for receiving a reflected signal, comprising: increased reflecting means for increasing the reflected signal; and means for varying the feed horn support arm, such that the feed horn is optimally positioned to receive the increased reflected signal.

To achieve the stated and other features and advantages of the present invention, an embodiment of the invention further provides a method for replacing an original reflector for an aimed satellite dish assembly, the assembly including the original reflector having an original reflective pattern, a base, and a feed horn attached to a feed horn support arm, the method comprising: providing an attachment device for attaching a replacement reflector to the assembly via the base; attaching the replacement reflector to the satellite dish assembly via the attachment device, the replacement reflector having a replacement reflective pattern, the replacement reflective pattern replacing the original reflector pattern; wherein no re-aiming of the satellite dish assembly is necessary.

To achieve the stated and other features and advantages of the present invention, an embodiment of the invention further provides a satellite dish mounting device for mounting an enhancement dish reflector to an existing satellite dish without re-aiming the enhanced satellite dish reflector, wherein the existing satellite dish has an existing reflector, a feed horn, a mounting bracket, and a feed horn support arm, and wherein the enhancement dish reflector has a first axis and a second axis, wherein the first axis has a greater length than the second axis, and wherein the enhancement dish reflector has an angle of orientation of the first axis, the satellite dish mounting device comprising: an adjustment device for adjusting the angle of orientation of the enhancement dish reflector; and an attachment mechanism connected to the adjustment device, the attachment mechanism for attaching the satellite dish mounting device to one from a group of the existing reflector, the mounting bracket, and the feed horn support arm; wherein the enhancement dish reflector is attached via the satellite dish mounting device to the existing satellite dish; and wherein the enhancement dish reflector is adjustably oriented via the satellite dish mounting device so as to acquire an enhanced satellite signal.

To achieve the stated and other features and advantages of the present invention, an embodiment of the invention further provides a satellite dish enhancer for simultaneously acquiring a plurality of satellite signals for an existing satellite dish having a base, an existing parabolic reflector, a feed horn, and a feed horn support arm, the enhancer comprising: an enhancement dish reflector having a first axis and a second axis, wherein the first axis has a greater length than the second axis, and wherein the enhancement dish reflector has an angle of orientation of the first axis relative to a fixed position; a pedestal portion attachable to the parabolic dish reflector, the pedestal portion including an adjustment device for adjusting the angle of orientation of the enhancement dish reflector; and an enhancement feed horn portion for receiving the plurality of satellite signals; wherein the enhancement dish reflector, the pedestal portion, and the enhancement feed horn portion are attached to the existing satellite dish; and wherein the enhancement dish reflector is adjustably oriented via the pedestal portion so as to acquire simultaneously the plurality of satellite signals.

To achieve the stated and other features and advantages of the present invention, an embodiment of the invention further provides a method for using an existing satellite dish to obtain simultaneously a plurality of satellite signals, the existing satellite dish having a base, an existing reflector, an existing feed horn, and an existing feed horn support arm, the method comprising: providing an enhancement dish portion, the enhancement dish portion including: an enhancement reflector having an orientation and a shape so as to receive simultaneously a plurality of satellite signals; a pedestal portion, wherein the pedestal portion allows adjustment of the orientation of the enhancement reflector; and an enhancement feed horn portion for receiving the plurality of satellite signals reflected by the enhancement reflector; attaching the enhancement dish portion to the existing satellite dish; and adjusting the orientation of the enhancement reflector so as to allow the feed horn portion to receive simultaneously the plurality of satellite signals.

Additional advantages and novel features of the invention will be set forth in part in the description that follows, and in part will become more apparent to those skilled in the art upon examination of the following. These features may also be learned by practice of the invention.

DETAILED DESCRIPTION

Figure 1A:
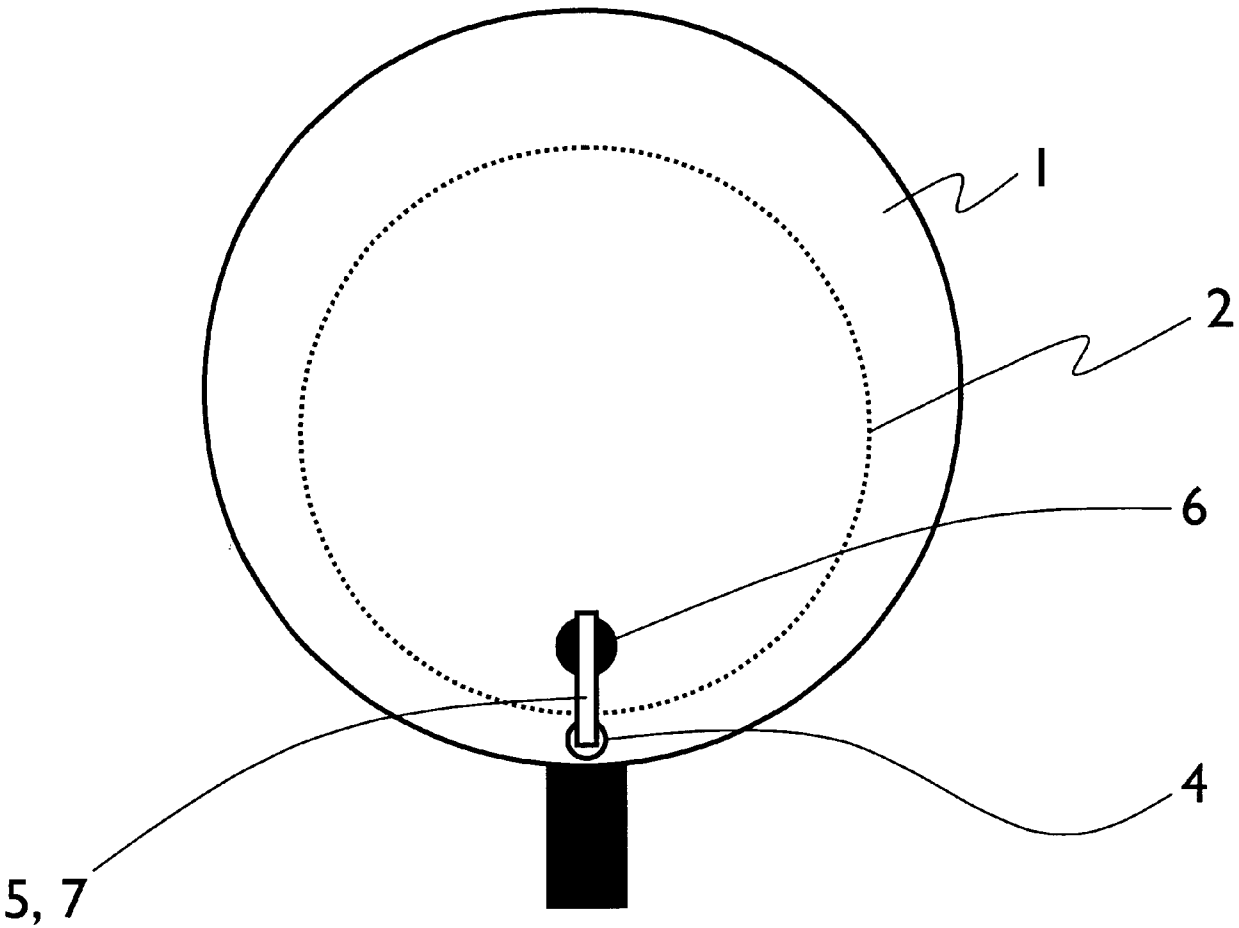
FIG. 1A presents a front view of a satellite dish enhancer, the reflector having an opening for receiving a feed horn support arm, in accordance with a first embodiment of the present invention.
Figure 1B:
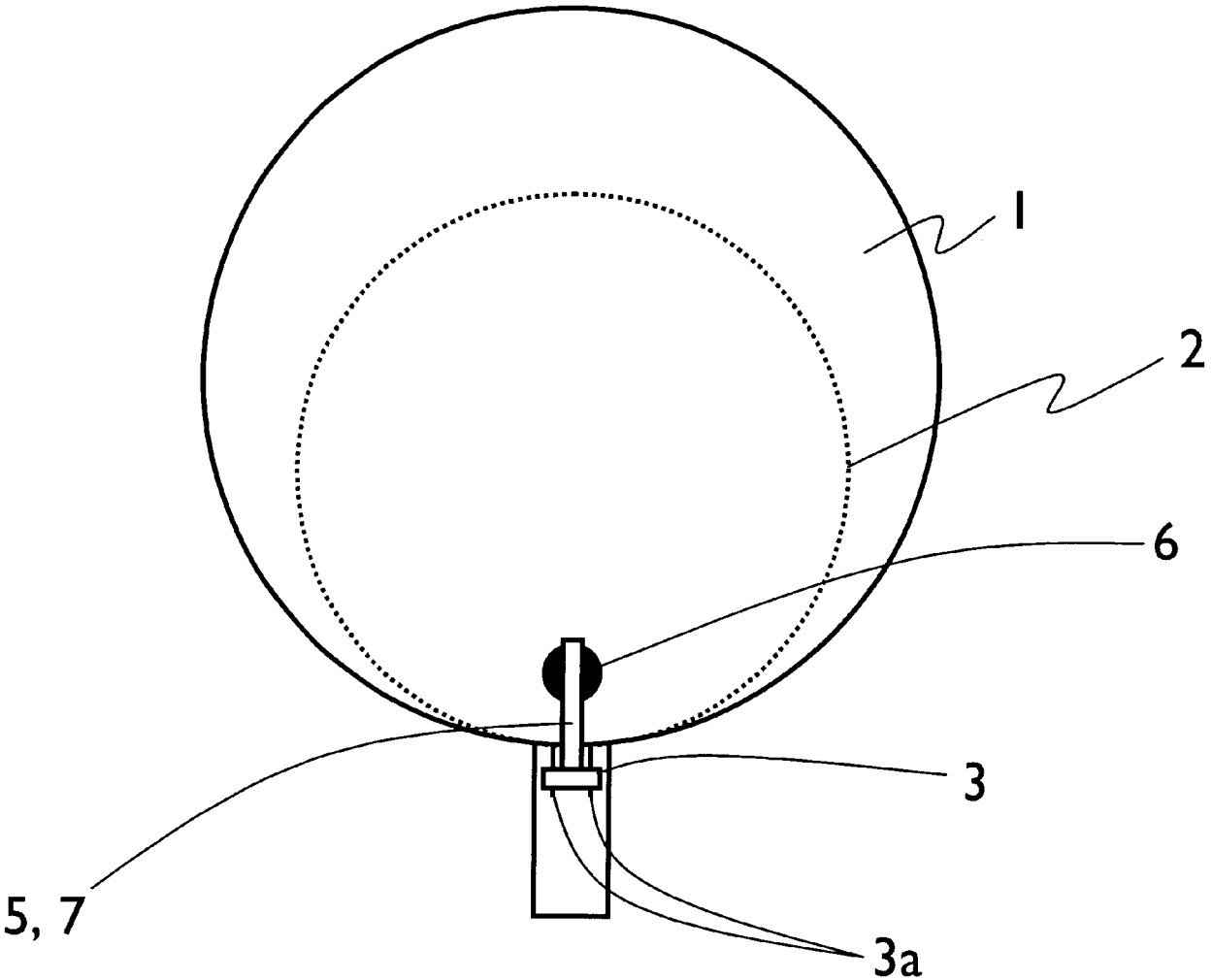
FIG. 1B shows a front view of a satellite dish enhancer, the reflector having no opening for receiving a feed horn support arm, in accordance with a first embodiment of the present invention.
Figure 1C:
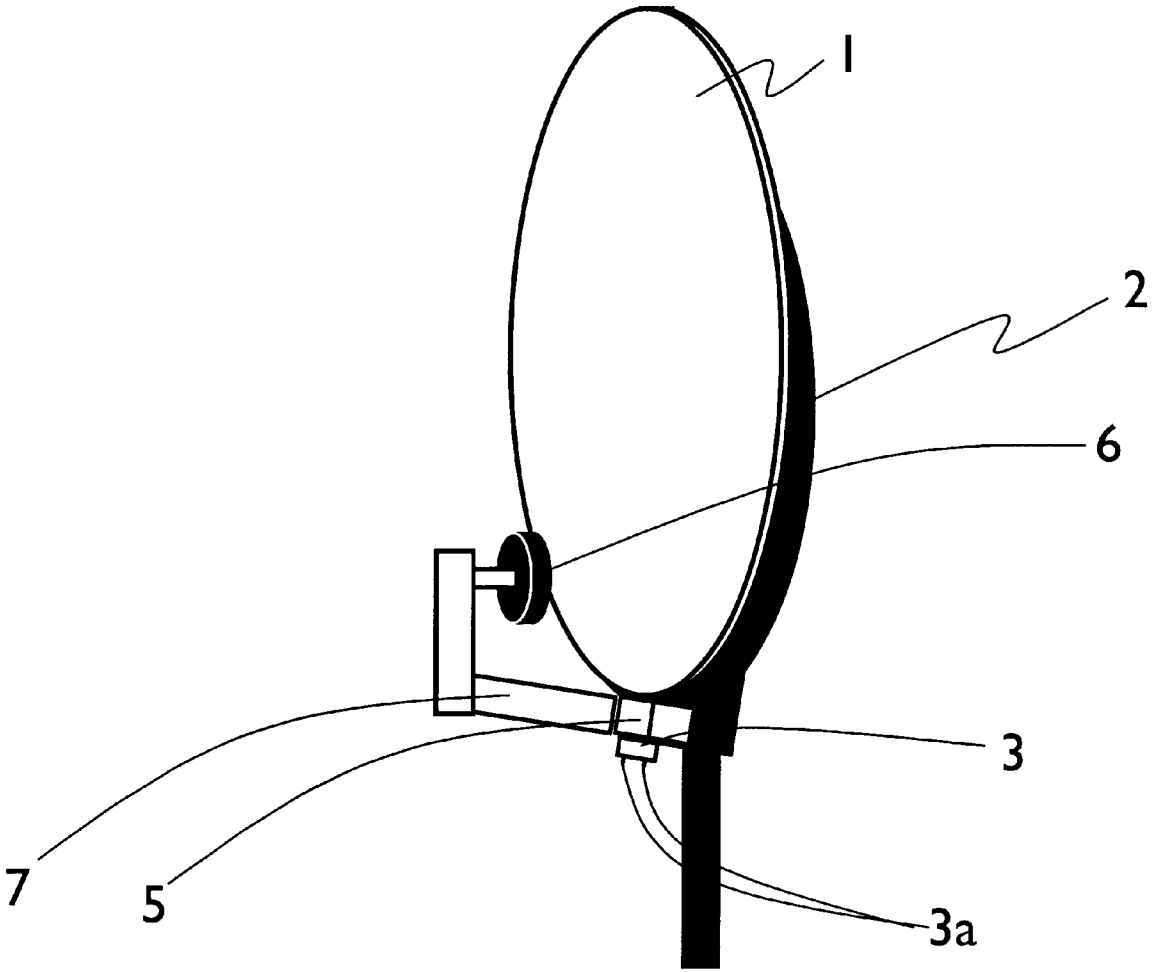
FIG. 1C is a front side view of the embodiment of FIG. 1B.

The present invention provides an easily installable enhancement for adding a new, typically larger parabolically curved dish surface area to an existing installed satellite dish. The new dish is fitted with fasteners, spacers, and other features that serve to locate it against the existing dish in position so as to operate optimally without re-aiming the assembly. The increased surface area has the same focal length to diameter ratio as the original dish, permitting the use of the original feed horn. The larger dish reflects more radiation towards the feed horn and thus produces a stronger signal. In an embodiment of the present invention, the reflective extension conforms to and extends the parabolic curvature of the original reflector, and a microwave lens formed of foamed Teflon or other material is attached to the feed horn, widening the illumination pattern, allowing the feed horn to collect the additional usable signal. In one embodiment of the present invention, the additional reflector area is further designed so as to avoid the "shadow" of the feed horn and its support arm, and to minimize surface area in the lower portion of the dish, which tends to collect such interfering material as snow and debris. In another embodiment, a new reflector is attached to the existing reflector or its mounting bracket. In conjunction with attaching the additional reflector, the feed horn is repositioned to the focal point of the new dish surface, utilizing an easily installable extension of the feed horn support tube or other extension feature. In one embodiment, this extension has an adjustment feature, allowing it to be adjusted to an optimal position. In another embodiment, the new reflector has its own attached dedicated feed horn support arm.

Increasing the dish diameter from 18 inches to 24 inches provides an increase in gain of approximately 2.5 dB for a typical satellite dish application. Thus, a small dish equipped with the present invention experiences reduced or eliminated loss of signal, loss of picture, or otherwise interfered with picture or sound during inclement weather or in any situation in which the satellite signal is partially blocked, such as, for example, by trees. An embodiment of the present invention also includes a dish that is made of a mesh material, which reduces weight and wind resistance.

These shape modifications are made to address the typical design of existing small dishes. Although an unmodified satellite dish would seemingly ideally consist of a round reflector with a feed horn in the center of it, because of the small size of typical satellite dishes, many have been designed in a modified way that addresses some problems with the apparent ideal design. In these modified designs, rather than including a whole parabolic dish with a feed horn in the center—where the feed horn blocks some of the signal from being received—the dish actually consists of only a portion of the potentially fully parabolic dish. With this design, the reflector consists of a partially parabolic shape situated entirely above or nearly entirely above the location of the feed horn. As a result, although the reflected area of the dish is much smaller than it potentially could be, the feed horn is out of the way of the received signals and the dish portion of the full 'parent' reflector reproduced is the part least prone to accumulating snow or other debris. It is thus clear that, in enhancing a satellite dish, the dish shape added can essentially reproduce any subpart or all of the full or "parent" parabolic dish that could potentially feed reflected signal to a feed horn located at a given focal point.

In a first pair of embodiments, the enhancement dish is, for example, a standard 24-inch reflector which, when superimposedly installed over the existing dish, extends the reflective surface approximately equally in all directions. In a second embodiment, the extension dish is a custom designed parabolic surface extension designed to extend the existing dish surface primarily in the upward and side directions at the edges of the existing dish when installed. In a third embodiment, the reflective addition is uniformly ring-shaped, extending about the periphery of the original dish at its edges. This embodiment uses a lens attached to the feed horn to collect signals that would otherwise be outside the area "illuminated" by the feed horn.

Each embodiment of the dish reflective extension is optionally designable such that the extension is easily removable, so that the user may add or remove the attachment as desired. The embodiments are also designable such that the dish mounts easily and permanently using, for example, pre-attached adhesive with peel-off backing, or snaps, clamps, or the like. According to one embodiment of the present invention, extra strength adhesive (e.g., glue) is used to attach the extension to the dish to ensure that the extension does not become disconnected from the dish, such as during a heavy wind. In another embodiment, the extension is snapped onto the dish using, for example, snaps that are attachable to the existing satellite dish. Many other methods of attaching the extension are well known in the art.

The amount of satellite signal received by a dish depends on the size of the dish and is directly proportional to the surface area of the dish. The signal is reflected to a collector, called the feed horn and directed to the LNB. In an embodiment of the present invention, signal reflected to the feed horn is increased by enlarging the size of the dish by adding a new parabolic surface of the same focal length to diameter ratio as the original dish. According to one embodiment of the present invention, the new dish is approximately 24 inches in diameter, effectively extending a typical 18-inch dish diameter by 6 inches. Such an extended dish approximately doubles the signal that is available at the collector and feed horn, and, as determined experimentally, increases antenna gain by approximately 2.5 dB. A dish of greater size may also be used to further increase signal gathering. The 24 inch reflector is a desirable size because the hardware supporting the 18 inch dishes, produced for 18 inch DSS systems, is designed to handle loads associated with reflectors up to this size.

Because a typical application of the present invention approximately doubles the surface area of the dish, the problem of signal loss is alleviated by correspondingly doubling the signal strength level. Thus, rain fade that would have otherwise occurred at the 20% to 30% signal level would not occur with use of an embodiment of the present invention because the signal strength will be doubled to about 40% to 60% at this level. With an embodiment of the present invention, signal loss occurs only when rain fade causes a loss of signal that approaches 10% to 15% of the full strength reception of an unenhanced dish. Examination of tables reporting histories of signal attenuation by rain suggests that doubling signal strength reduces rain fade occurrences by at least 75 percent.

Because the portion of the parabola that a typical small dish occupies varies with dish design, and because feed horns vary in the pattern of their "edge taper," the shape of the added dish varies among embodiments, but in all cases reproduces the shape of the outer circumference of the original dish, permitting the original feed horn to be used with the new reflector surface. For example, in one embodiment, the shape of the dish is oblong, with a smaller width and longer height. Although existing dish designs vary, generally two designs are most common in the market. One of the typical dish designs is more elliptical than the other dish designs, and the embodiment for an addition to this dish is specially tailored for application to this dish type.

In one embodiment of the present invention, the extension added to the dish is permanently affixed to the dish, extending from the outer edge of the dish. The extension of this embodiment is relatively small compared to the dish size (e.g., 3-inch width extension about the original 18-inch diameter dish) so that it does not present an unsightly appearance. Fabricating the extension out of mesh further minimizes any unwanted appearance of increased size of the dish. The mesh extension reflects microwave signals equivalently well in comparison to a solid extension and also has another beneficial effect—the mesh extension does not increase the wind resistance of the overall dish as much as a solid extension does, and does not typically weigh as much as a solid extension. One potential problem with wind or weight effects of the extension is that the strength of the mounting hardware of the original dish to which the extension is added may be insufficient to support much additional pressure. Because the surface area of the dish is approximately doubled in order to double signal strength, the wind resistance of the dish is also potentially doubled absent use of a mesh extension. DSS systems sold in the United States to date typically have used mounting hardware designed to handle the loads of the 24 inch dish.

In an embodiment of the present invention in which the extension is fabricated from a solid material, such as metal or plastic embedded with metal, the extension is cheaper to produce but is cosmetically less desirable and also has a greater resistance to wind. Because of the increased wind resistance of this embodiment, as discussed above, in some cases the expanded size of the dish could possibly stress the hardware that holds the original dish such that the system components fail. To address this problem, in one embodiment, the solid extension is designed to be easily removable in the event of, for example a storm or prediction of high winds. The user may thus remove the extension as desired, at any time.

References will now be made in detail to embodiments of the present invention, examples of which are illustrated in the accompanying drawings.

As shown in FIGS. 1A–1F the first embodiments of the present invention comprise an easily installable parabolic dish surface addition 1, which increases reflective surface area when superimposedly attached to an existing satellite dish 2. The added dish surface 1 retains the circumferential shape of the original dish 2, and also retains the focal length to diameter ratio of the original dish 2, both of which are necessary to maintain compatibility with the original feed horn 6. The added larger dish 1 is thus "flatter" in profile over a given surface area, permiting easy coupling with the original dish 2 (e.g., attaching or mounting to the original dish). The addition of the reflective addition increases the distance between the focal point of the added dish 1 and the surface of the added dish 1, which is addressed by using a support arm extension addition 7.

In the first embodiment, as shown in FIG. 1A, shown from a view facing the added dish surface 1, a hole 4 is provided near the bottom edge of the added dish 1 for receiving the original feed horn support arm 5 and the feed horn support arm addition 7. Also shown in FIG. 1A is the outline of the original dish 2, which is located behind the newly added dish surface 1.

Figure 1D:
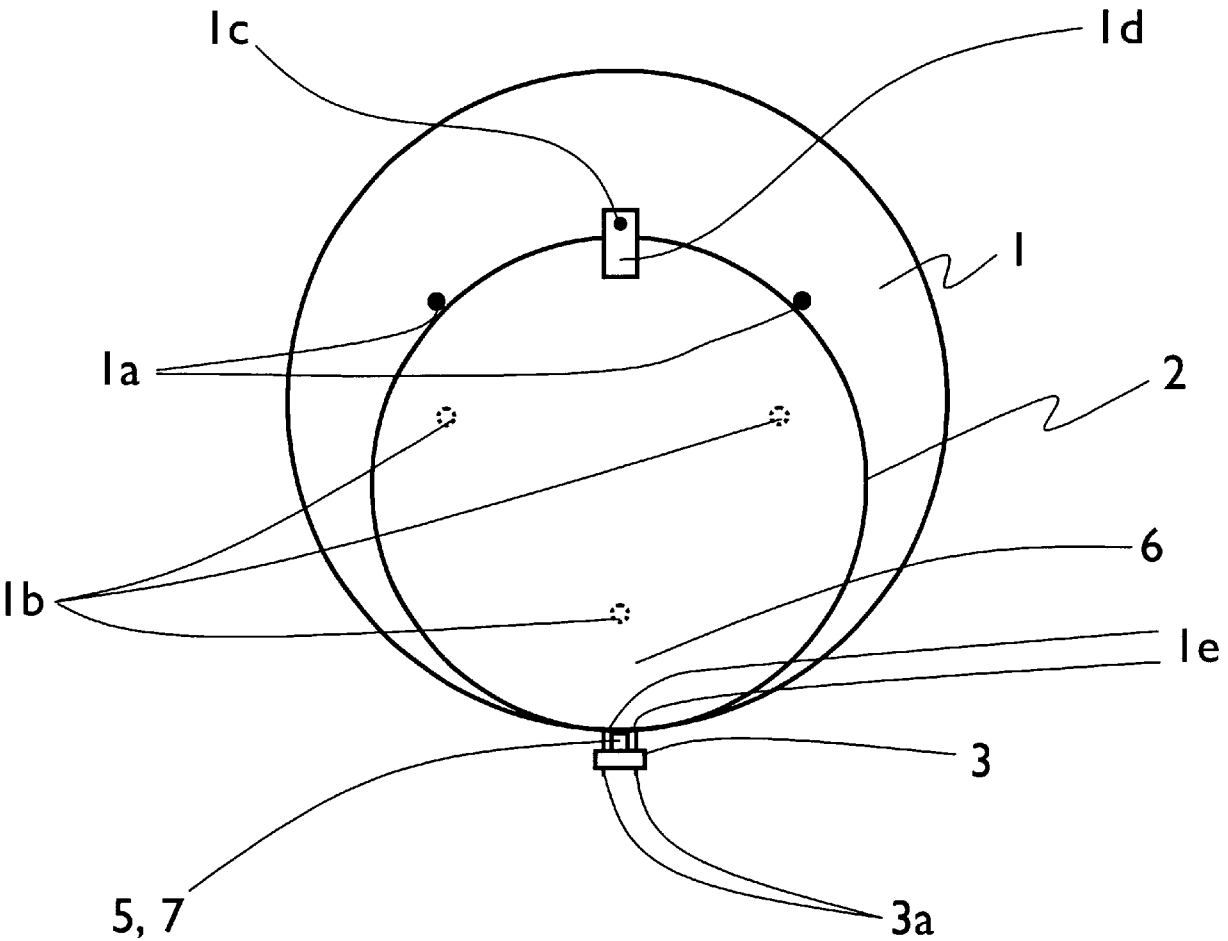
FIG. 1D presents a rear view of the embodiment of FIG. 1B.
Figure 1E:
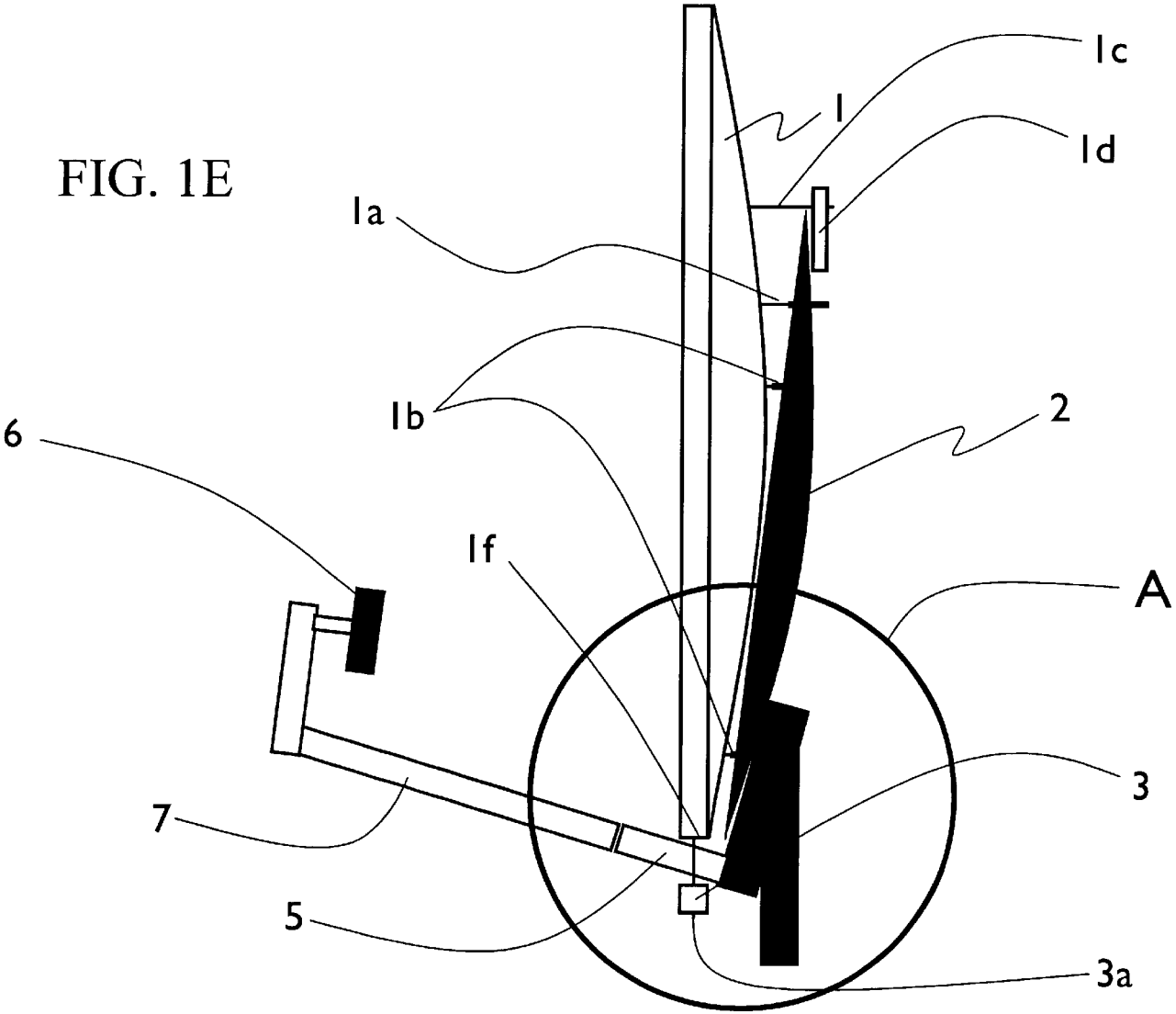
FIG. 1E shows a side view of the embodiment of FIG. 1B.
Figure 1F:
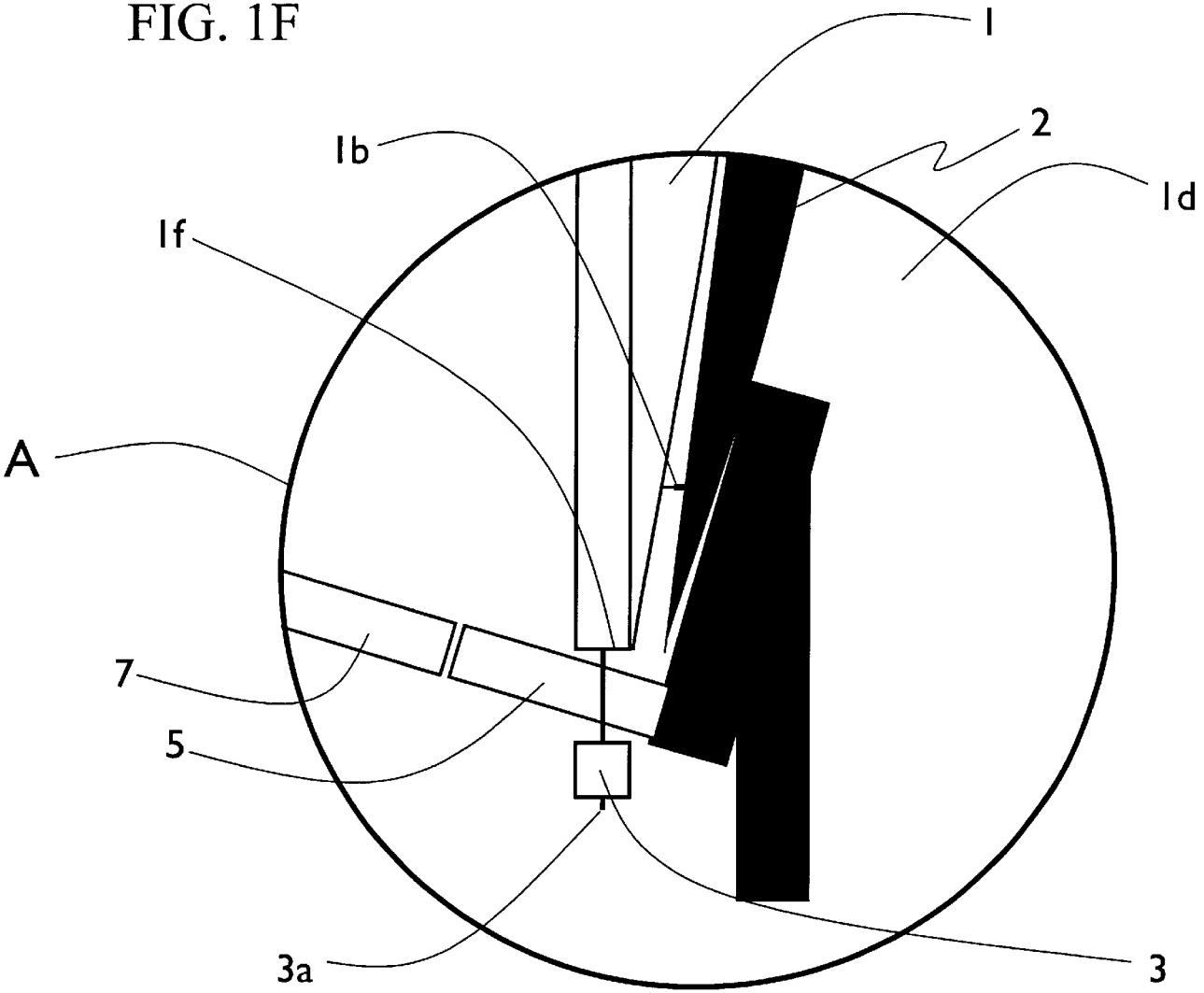
FIG. 1F is a closeup of area A as indicated in FIG. 1E.

In the first embodiment, as shown in FIGS. 1B–1F, the added dish 1 includes no hole 4, as shown in FIG. 1A, but is mounted entirely above the location of the feed horn support arm 5 and extension 7, as shown particularly in FIGS. 1E and 1F. This embodiment further includes a bottom bracket 3 and one or more fasteners 3*a*, such as bolts, for attaching the bottom of the added dish 1 to the feed horn support arm 5 and extension 7. As further shown in FIG. 1C, the feed horn 6 is repositioned to a new focal point for the dish addition 1, which is located at the distance produced using the original feed horn support arm 5 and the attached extension 7.

FIG. 1D presents a rear view of the assembled dish assembly. An embodiment of the present invention, as shown in FIG. 1D, includes a number of features that ease installation of the added dish 1. These features include one or more guide studs 1*a* for locating the added dish 1 relative to the original dish 2, and one or more dish resting studs 1*b* for supporting the added dish 1, which are shown in outline. The studs 1*b* are located between the added dish 1 and the original dish 2, as further shown in the profile of the assembly presented in FIG. 1E. (Note that the studs 1*b* are placeable at other locations, depending upon how the added dish 1 abuts the original dish 2 or other locations, such as the attached extension 7. For example, the added dish 1, in another embodiment, abuts the original dish 1 near the top of the original dish 2, and the added dish 1 abuts the feed horn support arm 5 near the bottom of the added dish 1, as viewed in FIG. 1E.) Other features of the embodiment shown in FIG. 1D include a top attaching bracket holding stud 1*c* and top attaching bracket 1*d* for holding the top of the added dish 1 relative to the original dish 2, and one or more fastening points 1*e*, such as pin nuts, attached to the lip 1*f* of the added dish, as further shown in FIG. 1E and the closeup A shown in FIG. 1F. The fastening points 1*e* enable attachment of the bottom bracket 3, to for example, the pin nuts, via fasteners 3*a*, such as bolts or other attachment devices, in order to sandwichably secure the feed horn support arm 5 and addition 7 between the dish addition 1 and the bottom bracket 3.

Figure 2A:
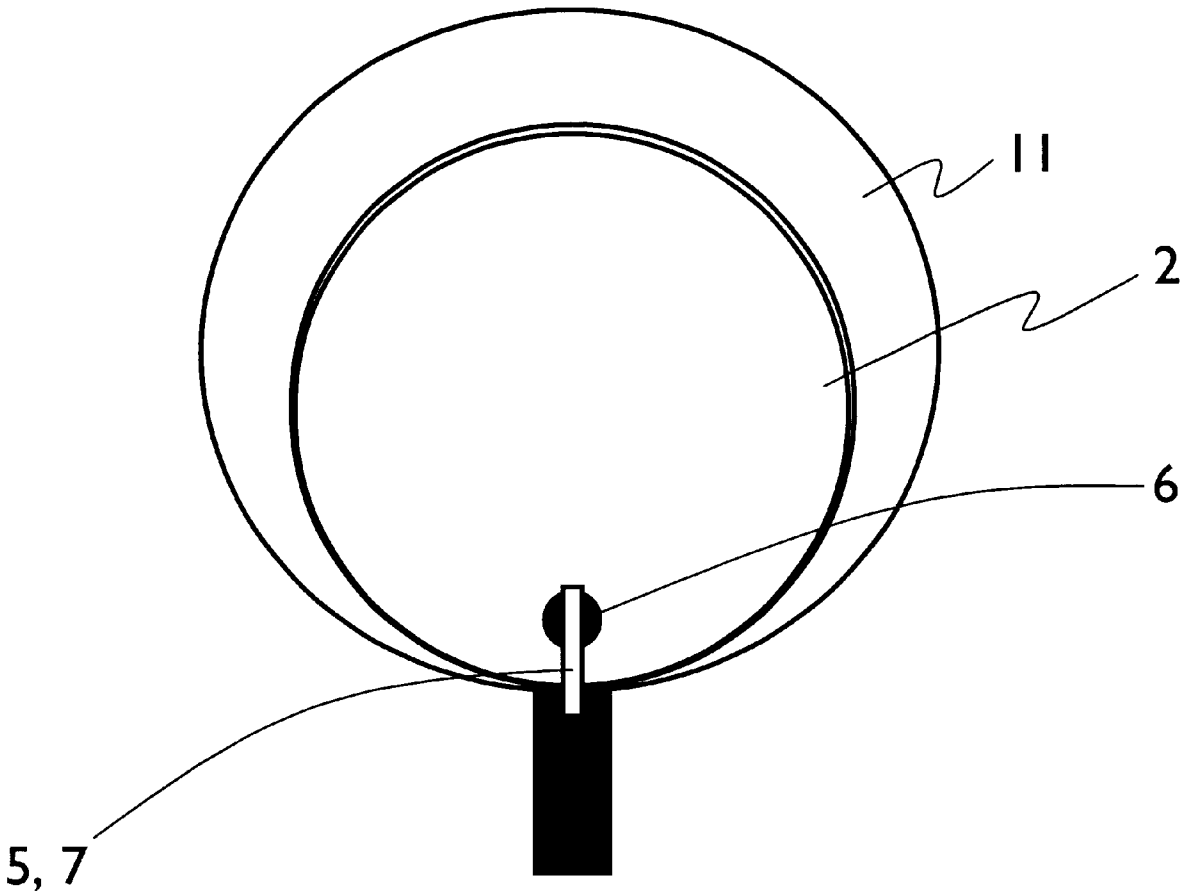
FIG. 2A presents a front view of a satellite dish enhancer, the added reflector having a generally ring shape and greater width in the portions above and to the sides of the original reflector, in accordance with a second embodiment of the present invention.
Figure 2B:
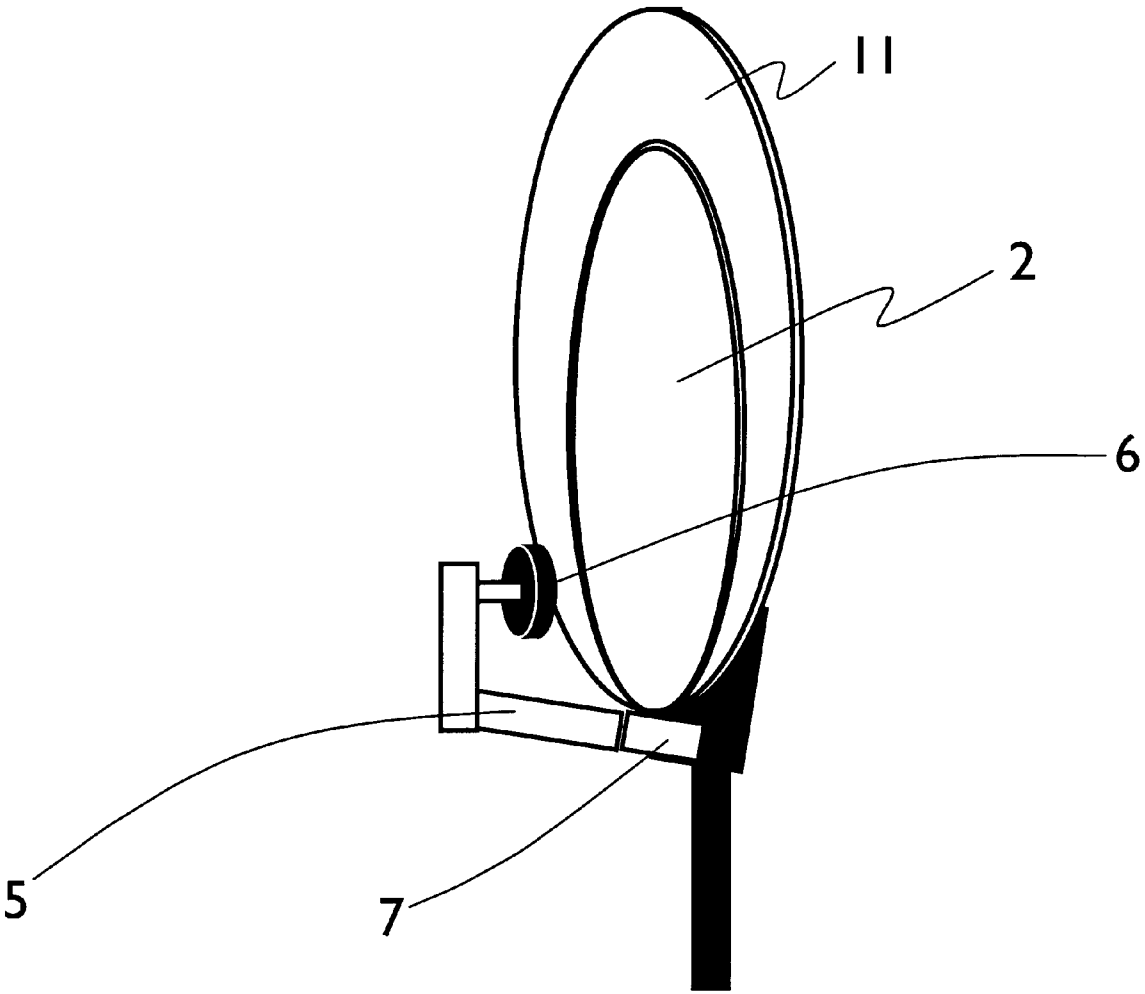
FIG. 2B is a front side view of the embodiment of FIG. 2A.

In the second embodiment of the present invention, the parabolic curve of a reflective "wing" 11 is added to produce a larger parabolic surface primarily above and to the sides of the original dish 2, as shown in FIGS. 2A and 2B. This extension 11 replicates the shape of the circumference of the original dish 2 when seen from the perspective of the feed horn 6 or incoming signal, conforming to the feed horn "illumination" pattern, except for the lower portion of the potential reflector area, so that the extension 11 avoids collection of rain, debris, or other material at its lower end. This configuration also avoids placing the surface of the addition 11 in the area where signal is blocked by the feed horn 6 and feed horn support bracket 5, 7. In this embodiment, the feed horn remains at the focal point of the original reflector, and a microwave lens made of foamed Teflon or other material is mounted to the face of the fashion to alter the collection or "illumination" pattern of the original feed horn, allowing the feed horn 6 to properly "illuminate" the dish addition 11.

Figure 3:
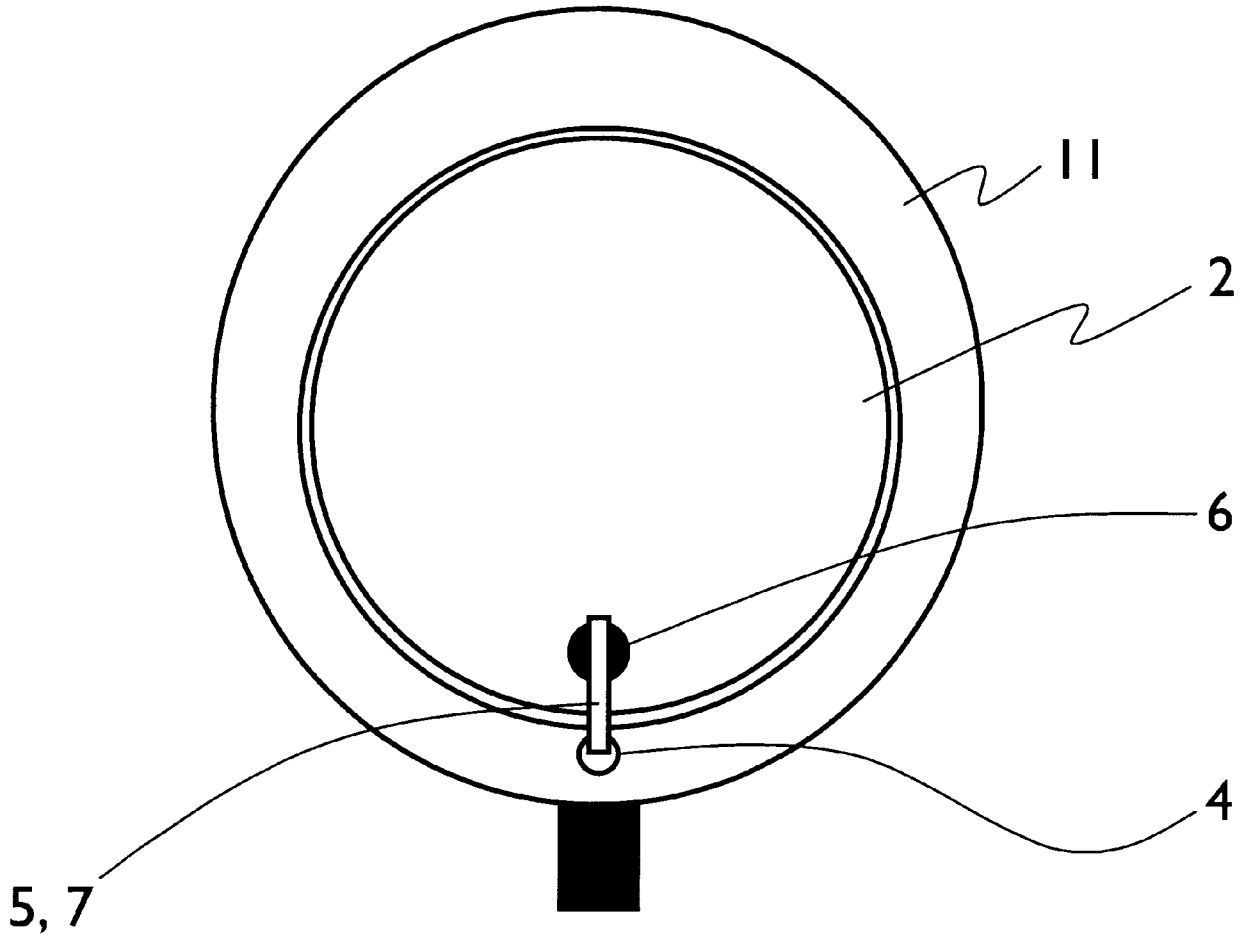
FIG. 3 shows a front view of a satellite dish enhancer, the added reflector having a uniform ring shape, in accordance with a third embodiment of the present invention.

The third embodiment, shown in FIG. 3, is similar to the second embodiment, shown in FIGS. 2A and 2B, but includes a reflector circumferentially equally extending in all directions, the extension being ring shaped. Here again, a microwave lens is used to collect the signal for the added area and feed this signal into the feed horn.

Figure 4A:
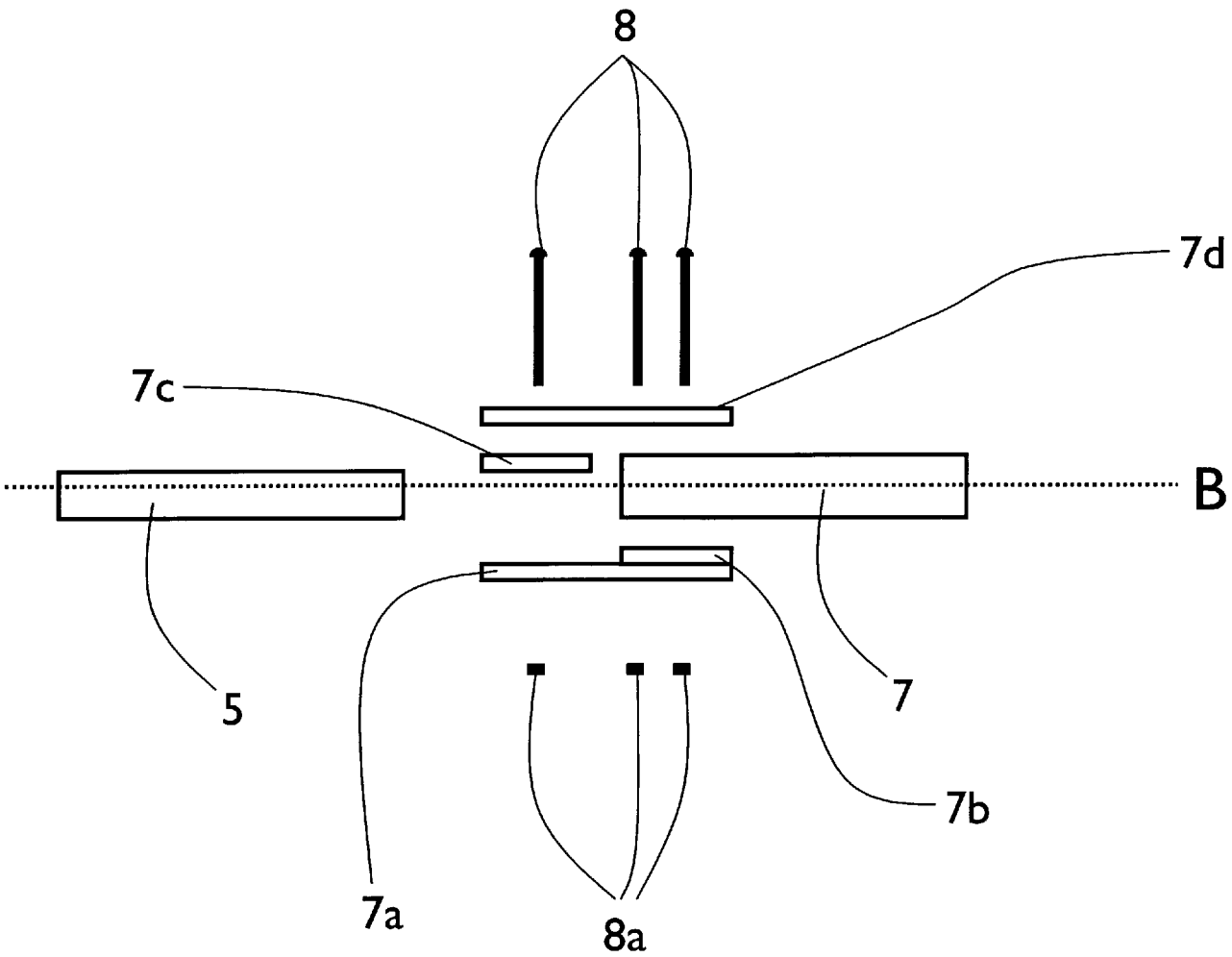
FIG. 4A presents a front exploded view of the support arm extension connecting mechanism in accordance with an embodiment of the present invention.
Figure 4B:
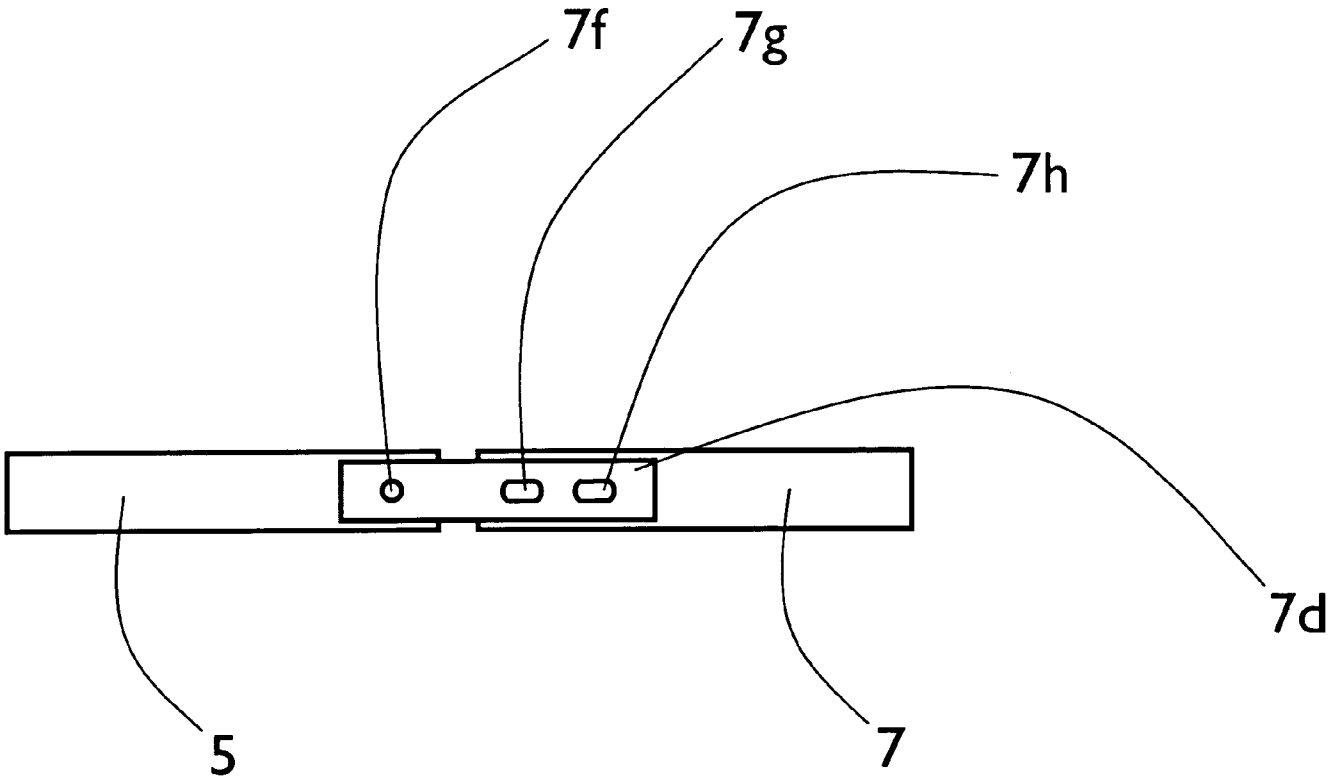
FIG. 4B shows an overhead view of the assembled support arm extension connecting mechanism of FIG. 4A.

FIGS. 4A and 4B detail aspects of the support arm extension 7 and connecting mechanism in accordance with one embodiment of the present invention. As shown in the cross-sectional view of FIG. 4A, the extension 7 is connected to the feed horn support arm 5 using a multipiece connecting mechanism. The connecting mechanism includes a first splint 7*a* coupled to a first spacer 7*b* for connecting one side of the support arm extension 7 to the feed horn support arm 5. A second splint 7*d* and a second spacer 7*c* connect a second side of the support arm extension. In an embodiment of the present invention, the splints 7*a*, 7*d* and spacers 7*c*, 7*d* sandwichably connect the support arm extension 7 and the feed horn support arm 5 using, for example, fasteners 8, 8*a*, such as screws or bolts and nuts or wing nuts, as well as washers and lock washers, or other connectors known in the art, including adhesive, nails, clips, cotter pins, or clamps.

In an embodiment of the present invention, the connecting mechanism is designed for use with a feed horn support arm 5 having a single hole at an end nearer the support arm extension 7 for receiving one fastener 8, 8*a*, and the support arm extension has a single hole at its end farther from the support arm 5 for connection to the satellite dish assembly.

Figure 4C:
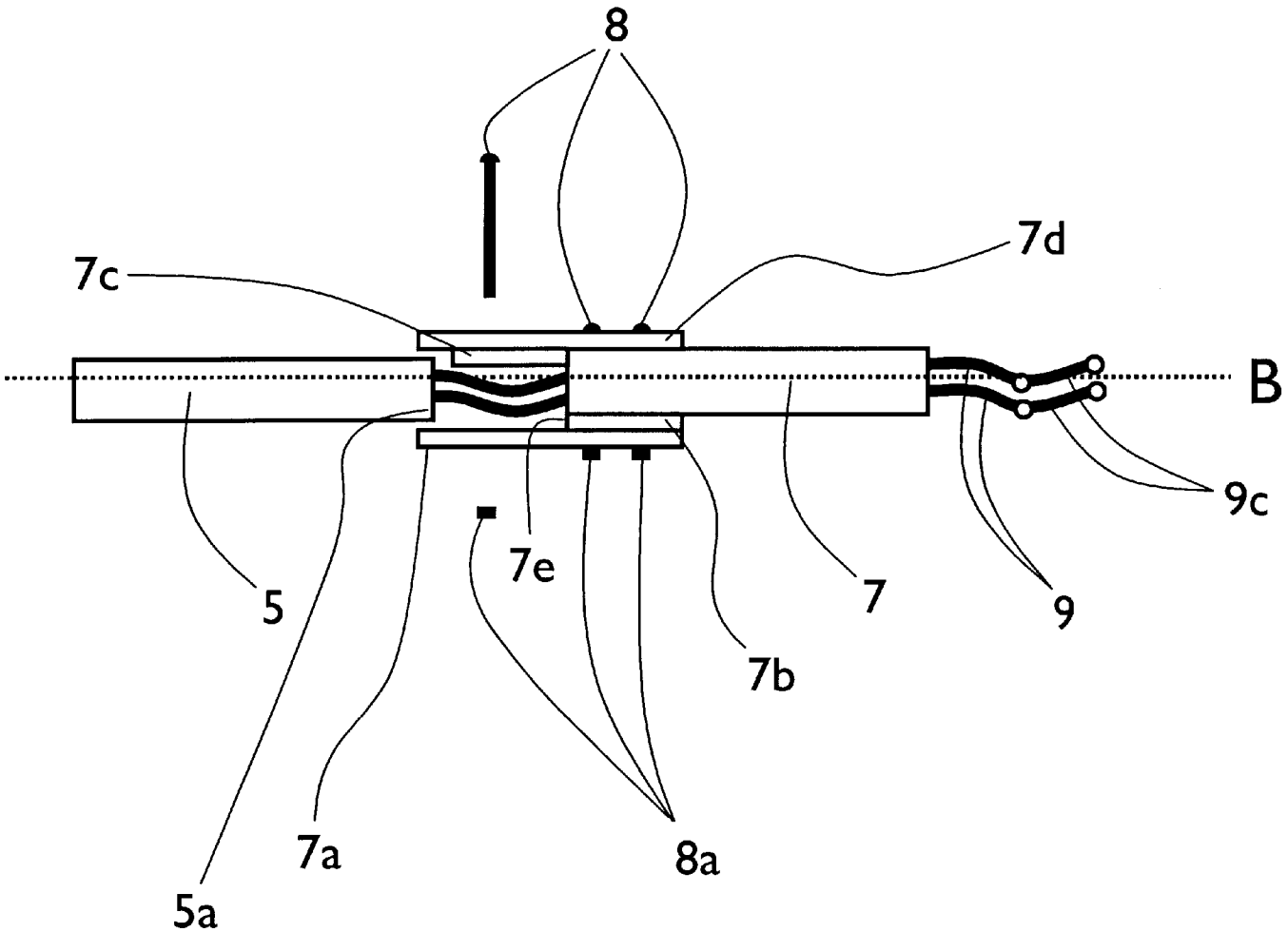
FIG. 4C is a front view of the partially assembled connecting mechanism of FIG. 4A.

To ease assembly, as shown in FIG. 4C, in an embodiment of the present invention, the coupled first splint 7*a* and first spacer 7*b* and the second splint 7*d* are first sandwichably coupled to the support arm extension 7. The feed arm support extension 5 is received into the opening between the splints 7*a*, 7*d*, such that the end 5*a* of the feed arm support extension 5 abuts one end 7*e* of the sandwiched first spacer 7*b*, which is fixedly held by the sandwich connection relative to the support arm extension 7. The second spacer 7*c* is received in the opening between the support arm extension 7 and the second splint 7*d*, and a third connector is used to sandwich the feed horn support arm 5, between the splints 7*a*, 7*d* and the spacer 7*c*.

In an embodiment of the present invention, the support arm extension 7 has a hollow central opening for receiving one or more connecting cables 9 for the feed horn. Connecting cable extensions 9*a* are optionally connectable to the connecting cables 9 to extend the length of the connecting cables, if necessary, to accommodate the additional length added to the feed horn extension 5 by attachment of the support arm extension 7.

Upon installation to a dish assembly, the support arm extension 7 thus moves the feed horn via the feed horn extension 5 a fixed distance relative to the dish surface, reflected primarily in the length of the support arm extension 7; and the spacer 7*c* offsets the feed horn relative to its previous centerline B, as shown in FIGS. 4A and 4C, allowing the feed horn to be positioned at the focal point for the dish addition. In an embodiment of the present invention, the offset of the feed arm extension 5 relative to the centerline B is approximately between ⅛" and ¼". The offset and length of the support arm extension 7 are tailorable to the original dimensions of the satellite dish (e.g., focal distance to original feed horn location, length of feed horn extension 5, and shape of original dish reflector impact the length of the support arm extension 7 and the offset from the centerline B necessary for dish additions).

FIG. 4B presents an overhead view (perpendicular to the view of FIG. 4A) of the assembled feed horn support arm 5 and support arm extension 7 connected by connecting mechanism, including the second splint 7*d*. In this embodiment, the second splint 7*d* includes a first opening 7*f* for receiving a connector to sandwiching the feed horn support arm 5, and two adjustable openings 7*g*, 7*h* for sandwiching the support arm extension 7. The adjustable openings 7*g*, 7*h* allow adjustment of the overall length of the feed horn support arm 5 and support arm extension 7.

In FIGS. 4A–4C, a square cross sectional extension is shown. In another embodiment of the present invention, a "D" shaped cross sectional extension is used with a single pair of bolts. The "D" shaped cross sectional extension accommodates both square and "D" shaped feed horn support arms.

Figure 5B:
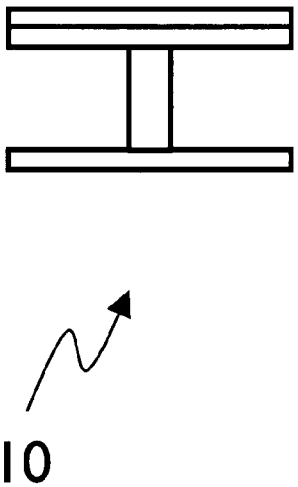
FIG. 5B shows an end view of the alternative connecting mechanism of FIG. 5A.
Figure 5A:
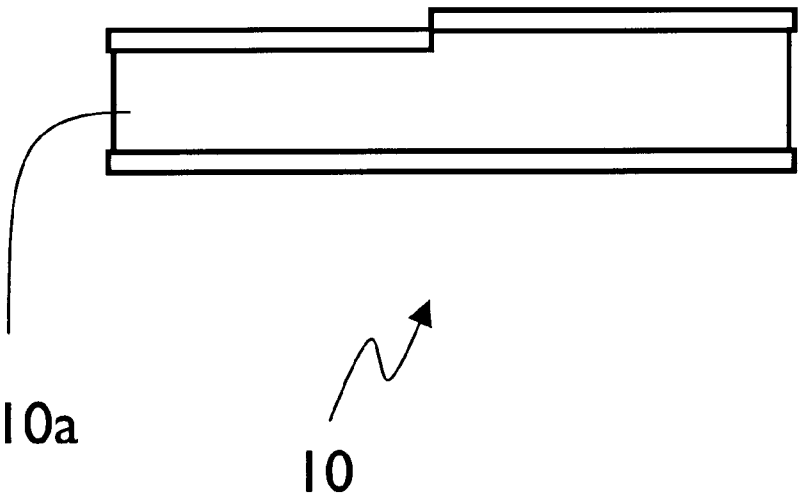
FIG. 5A presents a side view of an alternative connecting mechanism in accordance with an embodiment of the present invention.
Figure 5C:
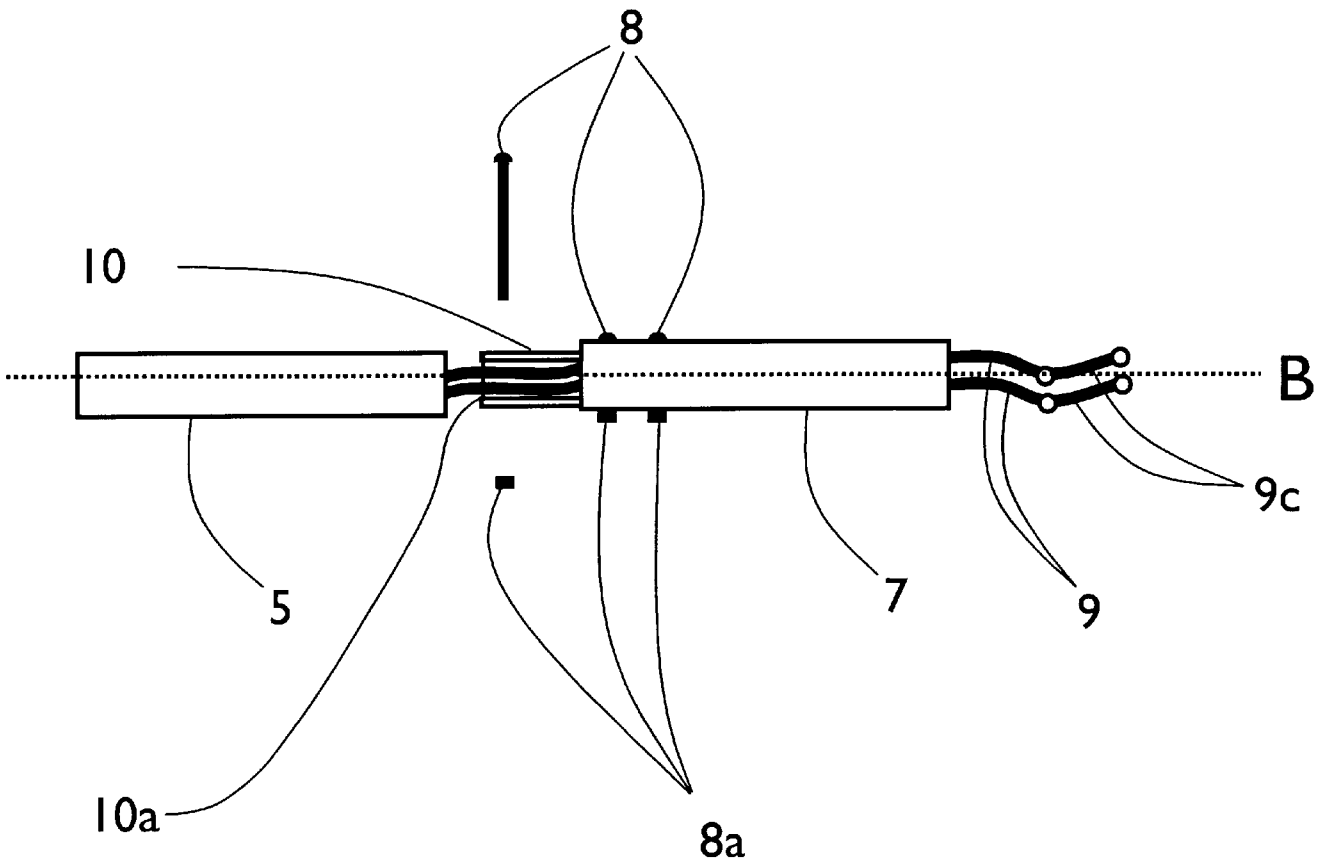
FIG. 5C is a front view of the partially assembled connecting mechanism, feed horn support arm, and support arm extension of FIG. 5A.

FIGS. 5A and 5B show an alternative support arm connector assembly 10 in accordance with another embodiment of the present invention. In this embodiment, the alternative connector assembly 10 comprises an "I-shaped" profile, as shown in the end view of FIG. 5B, and has an offset section at one end 10*a* for offsetting the feed horn extension 5, as shown in FIG. 5A. In assembly, as shown in FIG. 5C, the alternative support arm connector assembly 10 is receivably held by two fasteners 8, 8*a* within the support arm extension 7, the feed horn extension 5 is receivably attached to the offset section at one end 10*a*, and the feed horn extension 5 and the connector assembly 10 are connected by a third fastener 8, 8*a*. The connecting cables 9 and optional cable extensions 9*a*, if used, are received within the interior of the I-shaped cross-section of the connector assembly 10.

Another embodiment involves replacement of the existing dish with a larger or otherwise varied dish providing enhancement features, using the existing dish mounting hardware and one or more adjustable adapters, referred to as mounting "pedestals," allowing replacement of the original dish with the enhancement dish without requiring reorientation or re-aiming of the enhancement dish, and, if necessary or desired, accommodating other features, such as skewing, twisting, or other rotation of the added dish. The present invention also allows adjustment of each of these parameters, which is particularly useful with receiving signals from multiple satellites simultaneously. In an embodiment of the present invention, the pedestal is used in conjunction with a feed horn extension, as disclosed, and multiple pedestals are packageable with a one or more enhancement dishes to allow the addition of the enhancement dish to a wide range of existing dish mountings.

Typically, existing dish mounting brackets include four mounting bolt holes for securing the original dish. In an embodiment of the present invention, the original dish is removed, and an adapter, referred to as a "pedestal," is attached to the original mounting holes. This "pedestal" is variable in design and mounting features so as to accommodate the range of installed mounting brackets. The dish is then attached to the pedestal, and a feed horn extension for repositioning the feed horn is utilized, as necessary, or one or more feed horns are preattached to the dish addition or attached to the dish addition, such that these feed horns move with the dish addition as skew or twist is adjusted. In addition, a specialized adapter, as is known in the art, may be used with the feed horn extension to allow multiple feed horns to be utilized simultaneously with the enhanced dish.

Figures 6A, 6B:
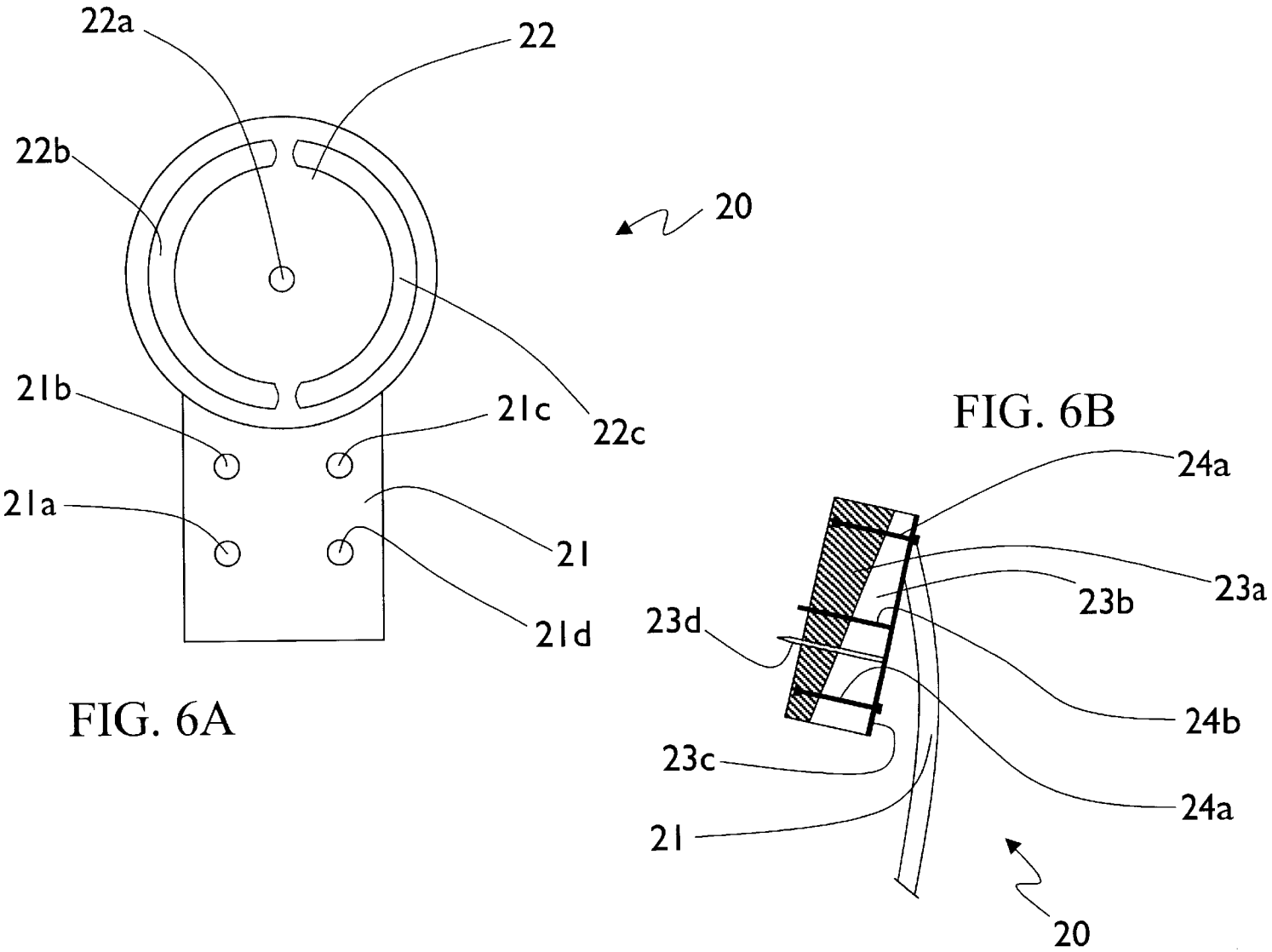
FIG. 6A shows a pedestal for use in conjunction with replacement of an existing reflective dish for a satellite dish assembly by an enhancement dish in accordance with an embodiment of the present invention, permitting "skew" adjustment.
FIG. 6B presents a side view of a pedestal in accordance with an embodiment of the present invention for simultaneous use of an enhanced dish with multiple satellites.

This embodiment is also usable in conjunction with known features for adjusting elevation, azimuth, and skew or tilt. For example, as shown in FIG. 6A, the pedestal 20 of one embodiment includes a base portion 21 having mounting holes 21*a*, 21*b*, 21*c*, 21*d* for mounting the pedestal 20 to an existing satellite dish base. The pedestal 20 also includes, for example, a dish attachment portion 22, which includes a center pivot hole 22*a*, and two slots 22*b*, 22*c* for skew adjustment of an attached enhancement dish.

FIG. 6B presents a side view of a pedestal in accordance with an embodiment of the present invention for simultaneous use of an enhanced dish with multiple satellites. The pedestal permits variable setting of offsets in azimuth and height from the aim of the existing dish, which allows adjustment based, for example, on the zip code of the location of dish installation. As shown in FIG. 6B, the pedestal 20 of this embodiment includes two cylindrical wedge-shaped portions, 23*a*, 23*b*, which are positioned adjacent to one another along the wedge-shaped section. The two wedge-shaped portions 23*a*, 23*b* are pressibly held together via, for example, a single bolt and nut 24*b*, which extends through the center hole of the two wedge-shaped portions 23*a*, 23*b* and the fixed plate 23*c*. The bolts and nuts 24*a* extend through a fixed base plate 23*c*, which is fixed to the base portion 21 of the pedestal 20, and are designable also for attachment of the dish to the pedestal, allowing adjustment of "skew" or "tilt." The bolts and nuts 24*a* extend through bolt hole openings in the base plate 23*c* and through curved slot portions in each of the wedge-shaped portions 23*a*, 23*b*, and the ends of the bolts and nuts 24*a* that are opposite the fixed base plate 23*c* optionally are recessed within the wedge-shaped portion 23*a*, or permit entry of mating pins attached to the enhanced dish, the attachment of an enhanced dish including integral bolts that pass through slots 22*b*, 22*c*, as shown in FIG. 6A. A central pivot screw 24*b* extends through a central opening in the two wedge-shaped portions 23*a*, 23*b*, and the fixed base plate 23*c*. The pivot screw optionally is designed as an integral part of an enhanced dish, or is designed to be recessed into the face of wedge 23*a* so as to accept a central pin attached to the enhanced dish.

Figure 6C:
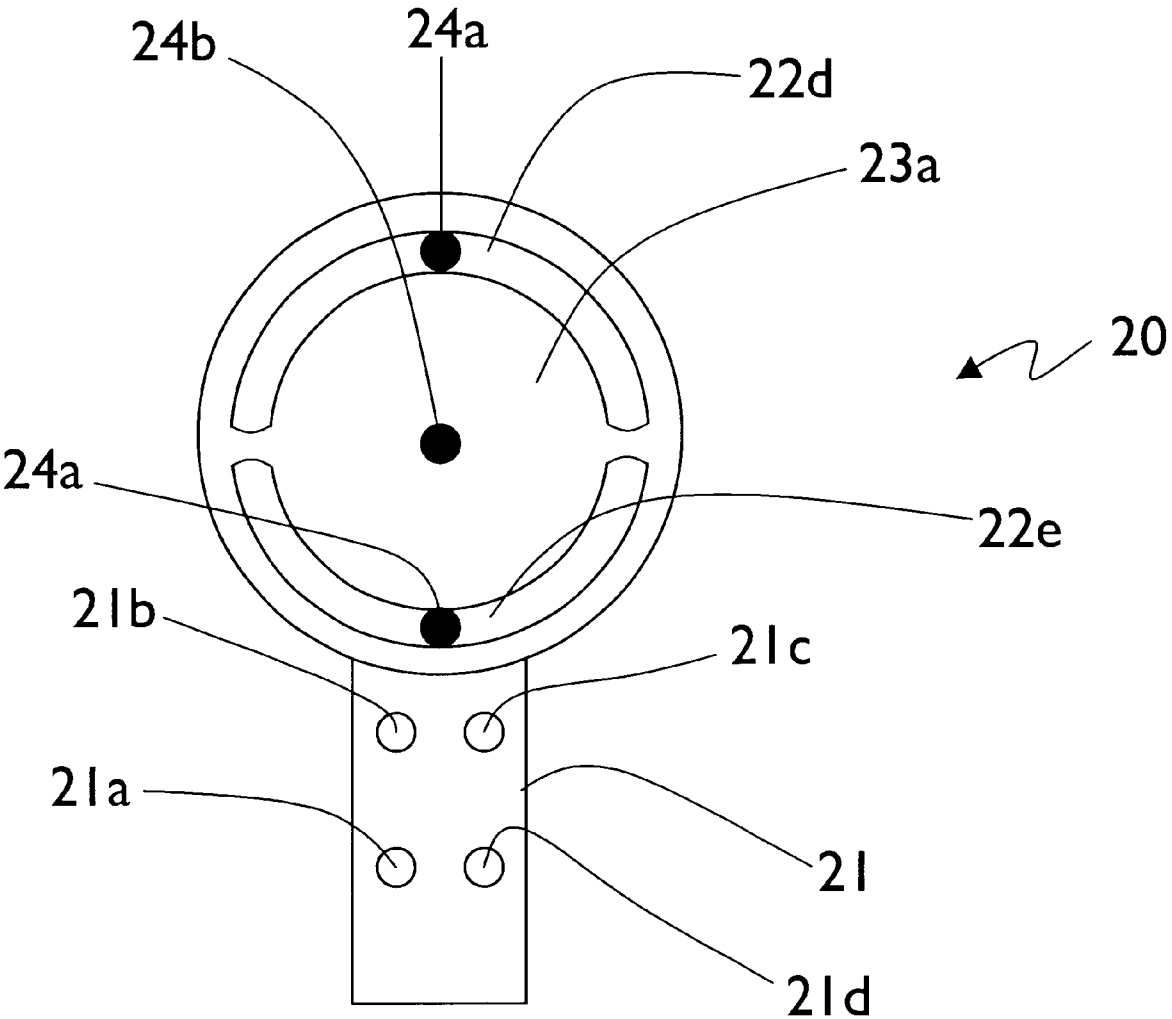
FIG. 6C presents a view of the pedestal of FIG. 6B.

FIG. 6C presents a view of the pedestal of FIG. 6B, as viewed facing the first wedge-shaped portion 23*a*. As shown in FIG. 6C, bolts and nuts 24*a* extend through slots 22*d*, 22*e* in wedge-shaped portion 23*a*. A center pivot screw or bolt 24*b* extends from the first wedge-shaped portion 23*a* for attachment to the center of a superimposedly placed enhancement dish 11, as further shown in FIG. 7.

Figure 6D:
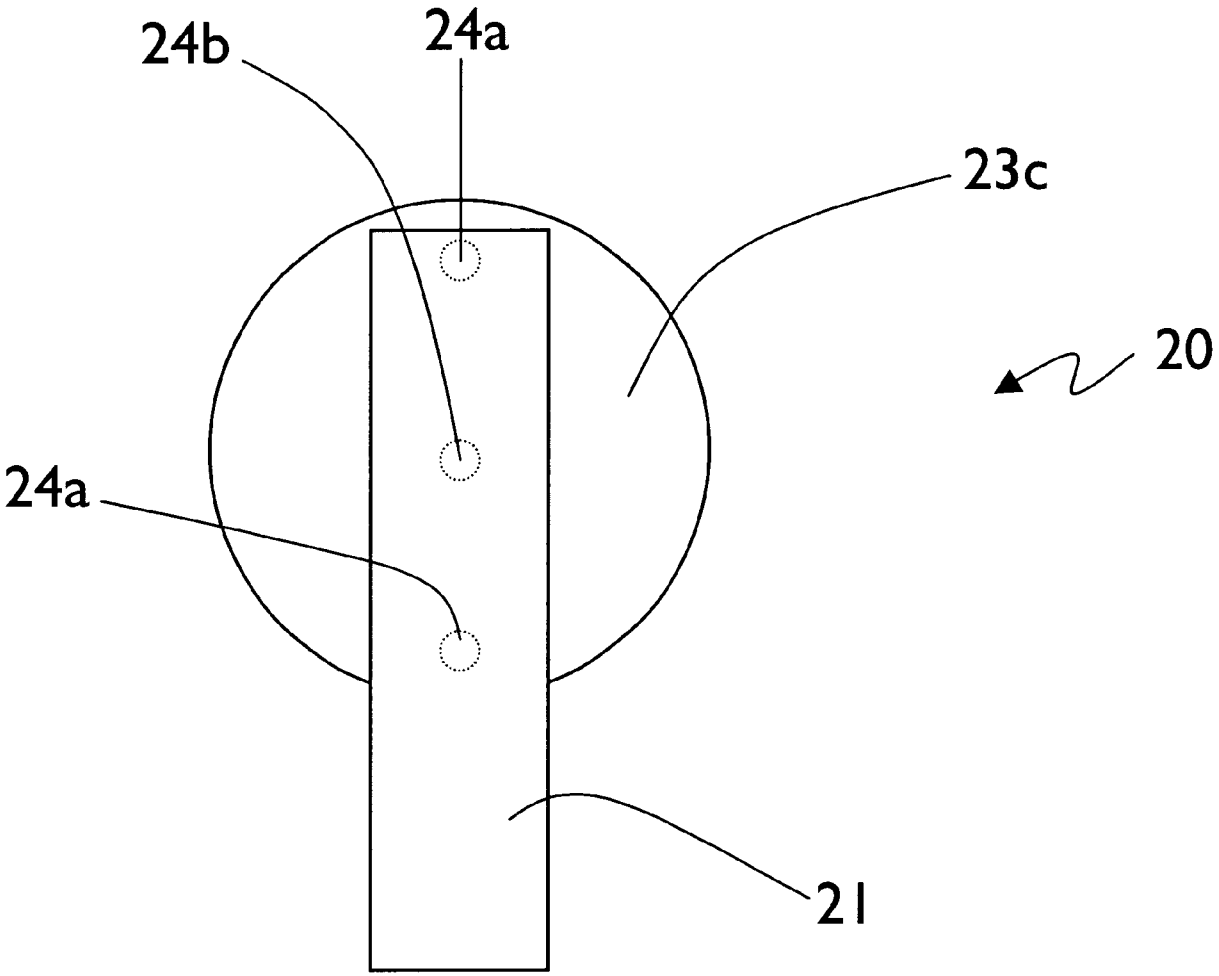
FIG. 6D presents a rear view of the pedestal of FIG. 6B.

FIG. 6D presents a rear view of the pedestal of FIG. 6B, as viewed facing the fixed base plate 23*c*. As shown in FIG. 6D, bolts or screws, beneath the base portion 21, extend through the base plate 23*c* for attachment of the two wedge-shaped portions 23*a*, 23*b* and the enhancement dish 11.

Figure 7:
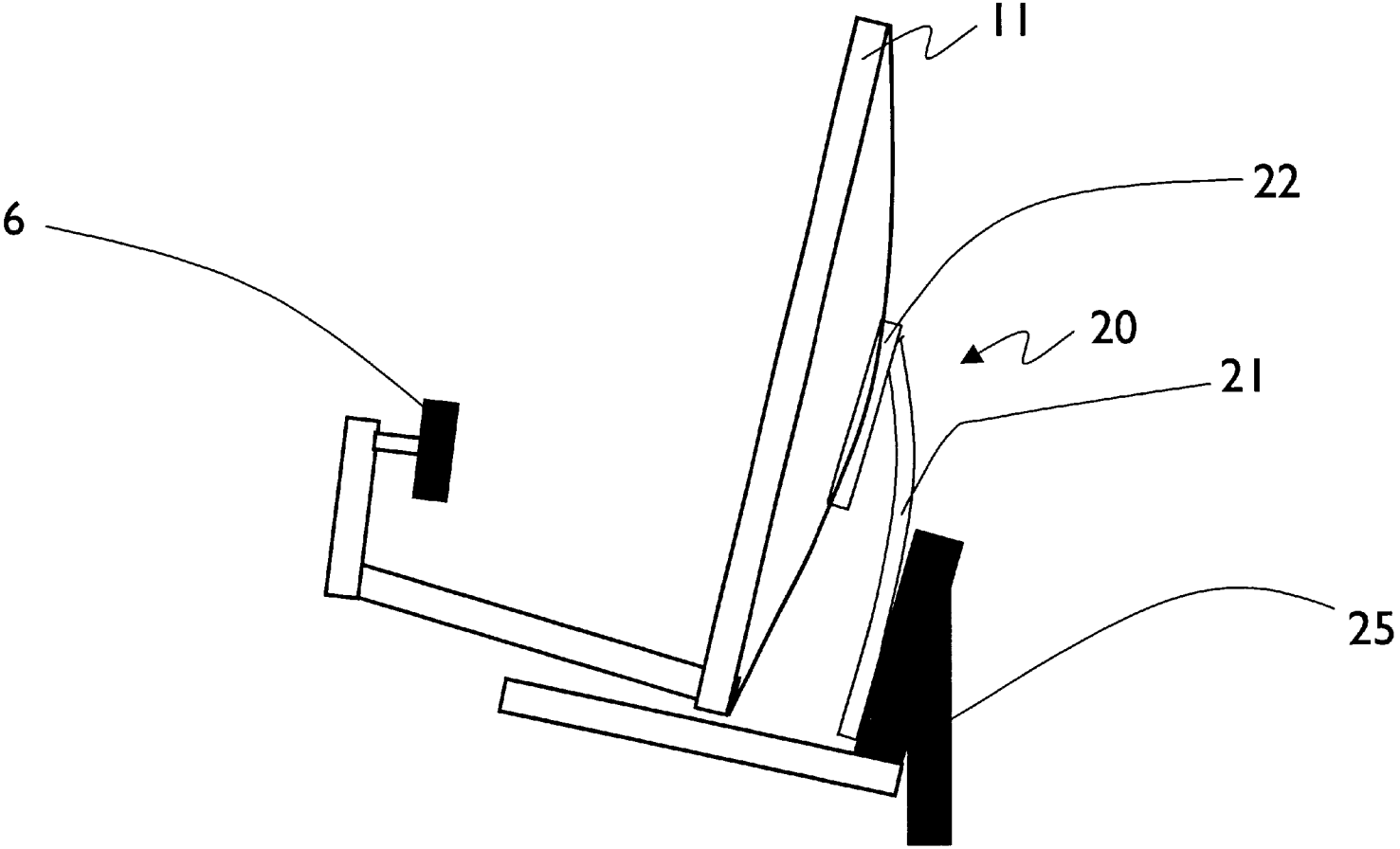
FIG. 7 presents a view of an assembled enhancement dish and pedestal with feed horn extension for an existing base, using the pedestal of FIGS. 6A–6D.

FIG. 7 presents a view of an assembled enhancement dish and pedestal with feed horn extension for an existing base, using the pedestals of FIGS. 6A–6D. As shown in FIG. 7, the original dish (not shown) is replaced with an enhancement dish 11, which is attached to the original base 25 via a pedestal 20. The dish attachment portion 22 of the pedestal 20, extends, for example, through the enhancement dish 11 and is attached at the center pivot hole 22*a* and slots 22*b* and 22*c* or 22*d* and 22*e*. The dish 11 optionally includes, for example, a dish scale or marking on the dish rear surface for determining dish skew relative to a fixed point, such as the indicator 23*d* attached to the fixed plate 23*c*, as shown in FIG. 6B. The indicator 23*d* also permits adjustment of pedestal offset. In another embodiment, the indicator 23*d* is designed with a wide end oriented toward the enhanced dish and carrying scale markings, which permits precise adjustment of "skew" relative to a marked point on the back of the enhanced dish. For example, the skew or twist adjustment may be made using a lookup table corresponding to the zip code where the dish 11 is located.

In operation of the embodiment of FIGS. 6B, 6C, 6D, and 7, the two wedge-shaped portions 23*a*, 23*b* are sandwiched between the base plate 23*c* and the attached enhancement dish 11. The attached enhancement dish is typically oblong shaped (e.g., parabolic and having one axis longer than a second, perpendicular axis) so as to allow gathering of signal from two satellites proximate to one another as viewed skyward from the dish 11. The orientation of the two satellites relative to one another, including the angle between a line connecting the satellites and the horizon, as well as the relative angle above the horizon of the satellites and the relative distance between the satellites typically varies with the latitude and longitude of the location of the dish 11. As a result, adjustment of angle and skew of the dish 11 must be made, depending on the location of the dish 11. By rotating the dish 11 with the two wedge-shaped portions 23*a*, 23*b* about the pivot point 24*b* using the slots 22*d*, 22*e*, the dish 11 is rotatable so as to be aligned with the angle of the two satellites from which simultaneous signal is sought.

To acquire the signal of both satellites, the dish 11 is typically oriented toward a point halfway between the two satellites. As a basic installed dish is aimed at one of the two (or more) satellite locations, the pedestal is designed to permit adjustment of a variable offset on two axes. The amount of needed offset from the original aiming direction is determined by the location of the dish installation. This embodiment allows rotation of the two wedge-shaped portions 23*a*, 23*b* relative to one another, so as to allow variation and adjustment in the orientation of the dish 11, so as to maximize signal gain from one or more satellites.

Because satellites typically remain in a geosynchronously fixed location relative to the Earth, for any known point on the Earth, an appropriate setting for offset angle on two axes and skew of the dish may be determined. For example, a table may be used that provides the appropriate angles and skews by zip code of the dish location. The table provides a setting for wedges 23*a*, 23*b* and skew of the dish. In one embodiment, the wedges 23*a*, 23*b*, as well as the dish reflective dish 11 itself, are rotated according to, for example, the table, using markings relative to a fixed pointer 23*d*, as shown in FIG. 6B. Incremental markings are made on the wedges, 23*a*, 23*b*, for example, and rotation of the wedges 23*a*, 23*b* to adjust offset occurs relative to the fixed pointer 23*d*, which is attached to the base plate 23*c*. Markings on the dish 11 may also be used to adjust the skew of the dish 11 relative to the fixed pointer 23*d*. In another embodiment, the fixed pointer 23*d* includes markings on the pointer 23*d*, relative to which, the dish 11 or wedges 23*a*, 23*b* are rotated. In one example of this embodiment, the fixed pointer 23*d* includes a T-shaped end having incremental markings on the cross portion. A reference mark on the dish 11 is then used as an alignment point relative to the incremental markings to obtain a predetermined rotation.

Thus, although some embodiments of the present invention describe various ways of attaching a new dish to an existing dish or its mounting hardware without the need to re-aim the dish, all embodiments allow the end user to perform fine adjustments to dish positioning after installation of the new dish. This can be accomplished by use of the original mounts, providing for adjustment of elevation and azimuth, and, in the case of a dish requiring "skew" adjustment, by the skew adjustment provided at the interface of the new dish and the "pedestal." There is significant benefit provided by an installation method that does not require the user to initially "acquire" the satellite signal before fine tuning can begin.

Embodiments of the present invention have now been described in accordance with the above stated advantages. It will be appreciated that these examples are merely illustrative of the invention. Many variations and modifications will be apparent to those skilled in the art.

I claim:

1. A satellite dish mounting device for mounting an enhancement dish reflector to an existing satellite dish without re-aiming the enhanced satellite dish reflector, wherein the existing satellite dish has an existing reflector, a feed horn, a mounting bracket, and a feed horn support arm, and wherein the enhancement dish reflector has a first axis and a second axis, wherein the first axis has a greater length than the second axis, and wherein the enhancement dish reflector has an angle of orientation of the first axis, the satellite dish mounting device comprising:

an adjustment device for adjusting the angle of orientation of the enhancement dish reflector; and an attachment mechanism connected to the adjustment device, the attachment mechanism for attaching the satellite dish mounting device to one from a group of the existing reflector, the mounting bracket, and the feed horn support arm;

wherein the enhancement dish reflector is attached via the satellite dish mounting device to the existing satellite dish; and wherein the enhancement dish reflector is adjustably oriented via the satellite dish mounting device so as to acquire an enhanced satellite signal.

2. The satellite dish mounting device of claim 1, wherein the adjustment device includes at least one wedge-shaped portion.

3. The satellite dish mounting device of claim 1, wherein the adjustment device includes at least one curved slot.

4. The satellite dish mounting device of claim 2, wherein each of the at least one wedge-shaped portion includes a curved slot for rotatably adjusting the at least one wedge-shaped portion.

5. The satellite dish mounting device of claim 4, wherein the attachment mechanism includes a fixed back plate portion, and wherein each of the at least one wedge-shaped portion is attached to the fixed back plate portion.

6. The satellite dish mounting device of claim 5, wherein the attachment mechanism includes a base portion, and wherein each of the at least one wedge-shaped portion is attached to the base portion via a connecting device extending through the curved slot of the at least one wedge-shaped portion.

7. The satellite dish mounting device of claim 5, wherein the attachment mechanism includes a base portion, wherein each of the at least one wedge-shaped portion includes a center hole, and wherein each of the at least one wedge-shaped portion is attached to the base portion via a connecting device extending through the center hole of each of the at least one wedge-shaped portion.

8. The satellite dish mounting device of claim 1, wherein the attachment mechanism includes a base portion.

9. The satellite dish mounting device of claim 8, wherein the base portion is attached to the feed horn support arm of the existing satellite dish.

10. The satellite dish mounting device of claim 8, wherein the base portion is attached to the existing reflector of the existing satellite dish.

11. The satellite dish mounting device of claim 8, wherein the base portion is attached to the mounting bracket of the existing satellite dish.

12. The satellite dish mounting device of claim 1, further comprising a marked scale.

13. The satellite dish mounting device of claim 12, wherein the marked scale is located on the attachment mechanism.

14. The satellite dish mounting device of claim 12, wherein the attachment mechanism includes a base portion, and wherein the marked scale is located on the base portion.

15. A satellite dish enhancer for simultaneously acquiring a plurality of satellite signals for an existing satellite dish having a base, an existing parabolic reflector, a feed horn, and a feed horn support arm, the enhancer comprising:

an enhancement dish reflector having a first axis and a second axis, wherein the first axis has a greater length than the second axis, and wherein the enhancement dish reflector has an angle of orientation of the first axis relative to a fixed position;

a pedestal portion attachable to the parabolic dish reflector, the pedestal portion including an adjustment device for adjusting the angle of orientation of the enhancement dish reflector; and an enhancement feed horn portion for receiving the plurality of satellite signals;

wherein the enhancement dish reflector, the pedestal portion, and the enhancement feed horn portion are attached to the existing satellite dish; and wherein the enhancement dish reflector is adjustably oriented via the pedestal portion so as to acquire simultaneously the plurality of satellite signals.

16. A method for using an existing satellite dish to obtain simultaneously a plurality of satellite signals, the existing satellite dish having a mounting bracket, an existing reflector, an existing feed horn, and an existing feed horn support arm, the method comprising:

providing an enhancement dish portion, the enhancement dish portion including: an enhancement reflector having an orientation and a shape so as to receive simultaneously a plurality of satellite signals; a pedestal portion, wherein the pedestal portion allows adjustment of the orientation of the enhancement reflector; and an enhancement feed horn portion for receiving the plurality of satellite signals reflected by the enhancement reflector;

attaching the enhancement dish portion to the existing satellite dish; and adjusting the orientation of the enhancement reflector so as to allow the feed horn portion to receive simultaneously the plurality of satellite signals.

17. The method of claim 16, wherein attaching the enhancement dish portion comprises:

attaching the pedestal portion to the existing feed horn support arm.

18. The method of claim 16, wherein attaching the enhancement dish portion comprises:

attaching the pedestal portion to the existing reflector.

19. The method of claim 16, wherein attaching the enhancement dish portion comprises:

attaching the pedestal portion to the mounting bracket of the existing satellite dish.

20. The method of claim 16, wherein the pedestal portion includes at least one wedge-shaped cylindrical portion, the at least one wedge-shaped cylindrical portion allowing adjustment in offset of the enhancement reflector, and wherein adjusting the orientation of the enhancement reflector so as to allow the feed horn portion to receive simultaneously the plurality of satellite signals comprises:

rotating the wedge-shaped cylindrical portion so as to vary the offset of the enhancement reflector.

21. The method of claim 16, wherein the pedestal portion includes at least two wedge-shaped cylindrical portions, the at least two wedge-shaped cylindrical portions allowing adjustment in offset of the enhancement reflector so as to allow the feed horn portion to receive simultaneously the plurality of satellite signals comprises:

independently rotating each of the wedge-shaped cylindrical portions so as to vary the offset of the enhancement reflector.

22. The method of claim 20, wherein the enhancement reflector is rotatable relative to the pedestal portion.

23. The method of claim 16, wherein adjusting the orientation of the enhancement reflector so as to allow the feed horn portion to receive simultaneously the plurality of satellite signals comprises:

determining a preferred adjustment using a lookup table.

* * * * *